US007020553B2

(12) United States Patent
Nakamura et al.

(10) Patent No.: US 7,020,553 B2
(45) Date of Patent: Mar. 28, 2006

(54) SIGNAL PROCESSING SYSTEM FOR CONSTRUCTION MACHINE

(75) Inventors: Kazunori Nakamura, Tsuchiura (JP); Toichi Hirata, Ushiku (JP); Yasushi Arai, Tsuchiura (JP); Yoichi Kowatari, Ibaraki-ken (JP); Gen Yasuda, Ibaraki-ken (JP); Hiroshi Watanabe, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 10/500,032

(22) PCT Filed: Aug. 25, 2003

(86) PCT No.: PCT/JP03/10686

§ 371 (c)(1),
(2), (4) Date: Jun. 24, 2004

(87) PCT Pub. No.: WO2004/018877

PCT Pub. Date: Mar. 4, 2004

(65) Prior Publication Data

US 2005/0071064 A1 Mar. 31, 2005

(30) Foreign Application Priority Data

Aug. 26, 2002 (JP) ..... 2002-245041

(51) Int. Cl.
*F04B 49/06* (2006.01)
*F04B 49/00* (2006.01)
*F02D 29/04* (2006.01)

(52) U.S. Cl. ..... 701/50; 701/103; 37/348; 37/382; 172/3; 60/431; 417/212

(58) Field of Classification Search ..... 417/212, 417/222.1; 60/431, 445; 172/2, 3; 37/348, 37/382, 234; 701/50, 99–115
See application file for complete search history.

(56) References Cited

U.S. PATENT DOCUMENTS 6,183,210 B1 2/2001 Nakamura ..... 417/222.1

FOREIGN PATENT DOCUMENTS

| | | |
|---|---|---|
| JP | 11-101183 | 4/1994 |
| JP | 6-202704 | 7/1994 |
| JP | 4-203484 | 7/1997 |
| JP | 10-266881 | 10/1998 |

*Primary Examiner*—Christopher J. Novosad
(74) *Attorney, Agent, or Firm*—Mattingly, Stanger, Malur & Brundidge, P.C.

(57) ABSTRACT

A machine body controller 70A includes a modification control unit 70Ab for computing a torque modification value based on detected signals from environment sensors 75 to 83, and modifies a maximum absorption torque of a hydraulic pump controlled by a basic control unit 70Aa. An engine controller 70B includes a modification control unit 70Bb for computing an injection modification value based on detected the signals from the environment sensors 75 to 83, and modifies a fuel injection state of a fuel injection device 14 controlled by a basic control unit 70Ba. The controllers 70A, 70B further include computation element altering units 171, 181. A communication controller 70C downloads alteration data obtained from an external terminal 150 to the computation element altering units 171, 181, whereby corresponding computation elements contained in the modification control units 70Ab, 70Bb are altered. As a result, it is possible in any environments to appropriately modify the maximum absorption torque of the hydraulic pump and the fuel injection state of the injection device, and to sufficiently develop the performance of a construction machine.

9 Claims, 11 Drawing Sheets

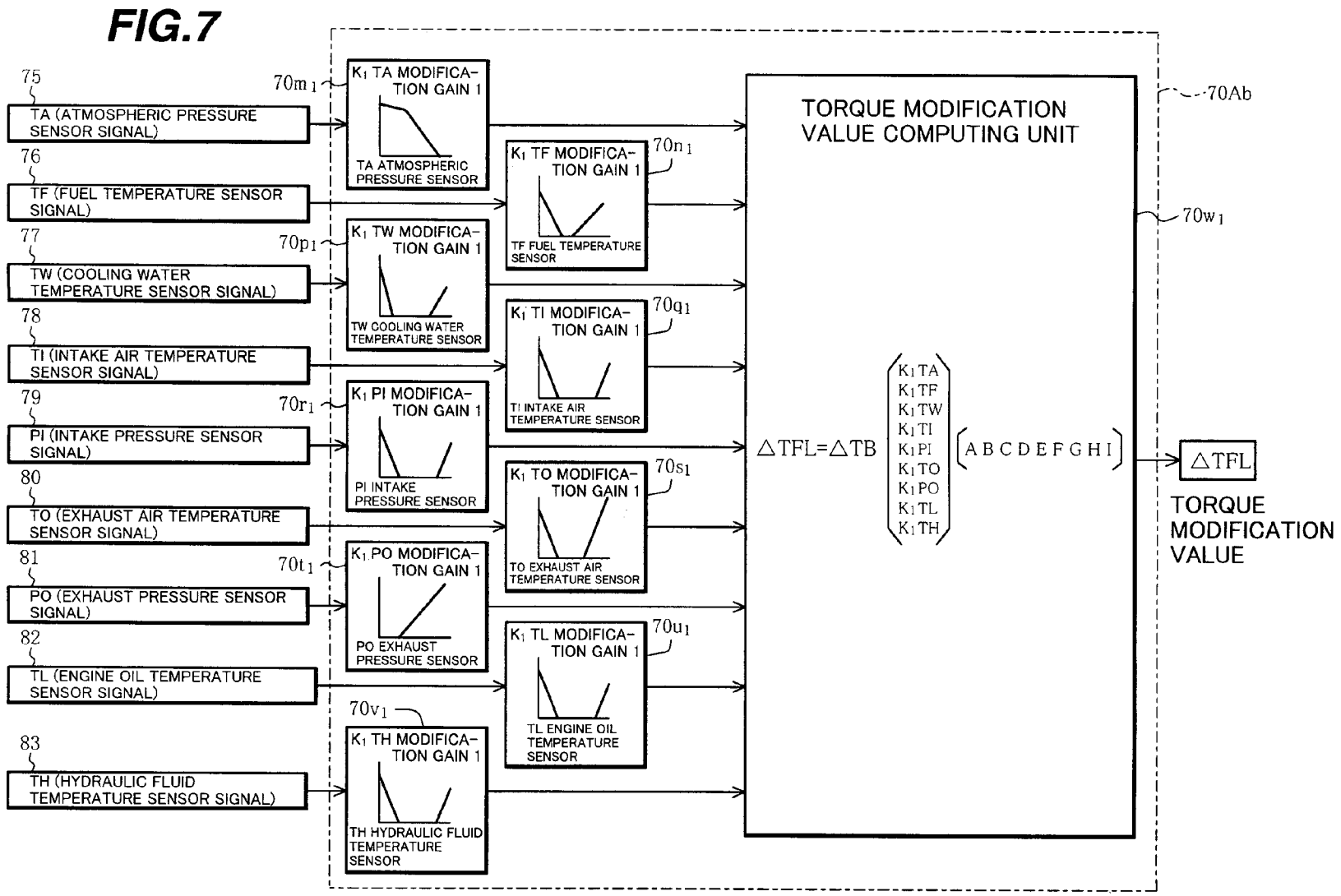
FIG.7
TA (ATMOSPHERIC PRESSURE SENSOR SIGNAL)
TF (FUEL TEMPERATURE SENSOR SIGNAL)
TW (COOLING WATER TEMPERATURE SENSOR SIGNAL)
TI (INTAKE AIR TEMPERATURE SENSOR SIGNAL)
PI (INTAKE PRESSURE SENSOR SIGNAL)
TO (EXHAUST AIR TEMPERATURE SENSOR SIGNAL)
PO (EXHAUST PRESSURE SENSOR SIGNAL)
TL (ENGINE OIL TEMPERATURE SENSOR SIGNAL)
TH (HYDRAULIC FLUID TEMPERATURE SENSOR SIGNAL)
K1 TA MODIFICATION GAIN 1
TA ATMOSPHERIC PRESSURE SENSOR
K1 TF MODIFICATION GAIN 1
TF FUEL TEMPERATURE SENSOR
K1 TW MODIFICATION GAIN 1
TW COOLING WATER TEMPERATURE SENSOR
K1 TI MODIFICATION GAIN 1
TI INTAKE AIR TEMPERATURE SENSOR
K1 PI MODIFICATION GAIN 1
PI INTAKE PRESSURE SENSOR
K1 TO MODIFICATION GAIN 1
TO EXHAUST AIR TEMPERATURE SENSOR
K1 PO MODIFICATION GAIN 1
PO EXHAUST PRESSURE SENSOR
K1 TL MODIFICATION GAIN 1
TL ENGINE OIL TEMPERATURE SENSOR
K1 TH MODIFICATION GAIN 1
TH HYDRAULIC FLUID TEMPERATURE SENSOR
TORQUE MODIFICATION VALUE COMPUTING UNIT
ΔTFL=ΔTB
K1TA K1TF K1TW K1TI K1PI K1TO K1PO K1TL K1TH
A B C D E F G H I
ΔTFL
TORQUE MODIFICATION VALUE
70Ab
70w1
70m1
70p1
70r1
70t1
70v1
70n1
70q1
70s1
70u1
75
76
77
78
79
80
81
82
83

SIGNAL PROCESSING SYSTEM FOR CONSTRUCTION MACHINE

TECHNICAL FIELD

The present invention relates to a construction machine such as a hydraulic excavator, and more particularly to a signal processing system for a construction machine, which is suitably equipped in the construction machine.

BACKGROUND ART

A construction machine, such as a hydraulic excavator, generally includes a diesel engine as a prime mover, and performs necessary work by rotationally driving at least one variable displacement hydraulic pump by the diesel engine and driving hydraulic actuators with a hydraulic fluid delivered from the hydraulic pump. The diesel engine is provided with an input means, e.g., accelerator lever, for commanding a target revolution speed. The fuel injection volume is controlled in accordance with the target revolution speed, whereby the engine revolution speed is controlled.

For such control of the engine and the hydraulic pump in the hydraulic construction machine, the so-called speed sensing control has hitherto been performed through the steps of determining the difference (revolution speed deviation) between the target revolution speed and an actual engine revolution speed outputted from a revolution speed sensor, and controlling an input torque of the hydraulic pump based on the revolution speed deviation. The speed sensing control is intended to reduce a load torque (input torque) of the hydraulic pump when the detected actual engine revolution speed is lower than the target revolution speed, thereby effectively utilizing the engine output while preventing stalling of the engine.

The engine output greatly changes depending on environments around the engine. When the hydraulic construction machine is used in, e.g., highland, an engine output torque reduces with lowering of the atmospheric pressure. JP,A 11-101183, for example, discloses the prior art capable of responding to changes in environments and suppressing a reduction of the engine revolution speed even when the engine output is reduced.

The disclosed prior art comprises a prime mover, a variable displacement hydraulic pump driven by the prime mover, a fuel injection device (governor) for controlling fuel injection in the prime mover, input means (target engine revolution speed input unit) for commanding a target revolution speed of the prime mover, revolution speed detecting means (revolution speed sensor) for detecting an actual revolution speed of the prime mover, a controller for controlling a maximum absorption torque of the hydraulic pump based on the target revolution speed commanded from the input means and the actual revolution speed detected by the revolution speed detecting means, and a plurality of sensors (e.g., an atmospheric pressure sensor and a fuel temperature sensor) for detecting various status variables (e.g., an atmospheric pressure and a fuel temperature) related to the environments of the prime mover and outputting corresponding detected signals for the respective status variables.

Further, in the prior art, the controller includes a torque modification value computing unit for modifying the maximum absorption torque of the hydraulic pump in accordance with the detected signals for the status variables. The controller previously stores tables, in number corresponding to the various sensors, for computing modification gains corresponding to the detected signals from the various sensors, and the torque modification value computing unit computes a torque modification value after applying predetermined weights to the modification gains computed based on the respective tables. Then, the controller sets, as a final target maximum absorption torque, the maximum absorption torque of the hydraulic pump, which has been modified by using the modified torque modification value, and then outputs the final target maximum absorption torque, as a command current value, to a corresponding solenoid valve.

DISCLOSURE OF THE INVENTION

In the prior art described above, influences of environment factors related to the operation status of the prime mover, such as the atmospheric pressure and the fuel temperature, upon control of the pump maximum absorption torque are estimated in advance, and estimated influence characteristics are tabulated into one table per factor. Then, the torque modification value is computed through the steps of computing the corresponding modification gains based on the respective tables with respect to the detected values from the various sensors, such as the atmospheric pressure sensor and the fuel temperature sensor, and totalizing the computed modification gains after applying the predetermined weights to them.

However, construction machines such as hydraulic excavators may be possibly operated under a variety of climate conditions all over the world, including land at very high altitudes, desert, marshland, extremely cold land, and extremely hot land. Further, fuel situations (such as fuel composition and legal restrictions on the kind of fuel) may be possibly different depending on countries and seasons. For that reason, even when the torque modification is made, as in the prior art, by preparing the tables in advance for environment factors related to the operation status of the prime mover, there is a possibility that, in some of working places and working conditions, the torque modification using only the tables is not sufficient to cope with all kinds of situations (e.g., in the case of the construction machine operating under conditions outside the varying ranges of the environment factors which have been assumed at the time of preparing the tables, or in the case where a table for the relevant environment factor has not been itself prepared).

In other words, there is yet room for improvement in the above-described prior art from the viewpoint of modifying the maximum absorption torque of the hydraulic pump in any environments in an appropriately responsive way so that the construction machine is able to sufficiently develop its performance.

While the above description is made of the maximum absorption torque control for the hydraulic pump, the fuel injection control performed by the fuel injection device associated with the prime mover (engine) has also been left under similar circumstances.

An object of the present invention is to provide a signal processing system for a construction machine, which can modify a maximum absorption torque of a hydraulic pump or a fuel injection state of a fuel injection device in any environments in an appropriately responsive way, and hence which enables the construction machine to sufficiently develop its performance.

(1) To achieve the above object, the present invention provides a signal processing system for a construction machine comprising a prime mover, a variable displacement hydraulic pump driven by the prime mover, a fuel injection device for controlling fuel injection in the prime mover, input means for commanding a target revolution speed of the prime mover, revolution speed detecting means for detecting an actual revolution speed of the prime mover, fuel injection control means for controlling a fuel injection state of the fuel injection device in accordance with the target revolution speed commanded from the input means and the actual revolution speed detected by the revolution speed detecting means, and pump torque control means for controlling a maximum absorption torque of the hydraulic pump in accordance with the target revolution speed commanded from the input means and the actual revolution speed detected by the revolution speed detecting means, wherein the signal processing system further comprises a plurality of environment detecting means for detecting status variables related to environments of the prime mover or the hydraulic pump and outputting respective corresponding detected environment signals; environment modifying means for receiving the detected environment signals and modifying, in accordance with the detected environment signals, at least one of the fuel injection state of the fuel injection device controlled by the fuel injection control means and the maximum absorption torque of the hydraulic pump controlled by the pump torque control means; communication control means for obtaining, from an external terminal via communication, alteration data for altering one or more computation elements contained in at least one of the fuel injection control means, the pump torque control means and the environment modifying means; and computation element altering means for altering the computation elements based on the alteration data obtained by the communication control means.

According to the present invention, the environment modifying means is provided which modifies the fuel injection state of the prime mover or the maximum absorption torque of the hydraulic pump based on estimation made in advance regarding influences of environment factors for the prime mover or the hydraulic pump, such as an atmospheric pressure and a hydraulic fluid temperature, which are possibly caused upon control of the fuel injection state of the prime mover or control of the maximum absorption torque of the hydraulic pump. When the construction machine is operated, the environment detecting means detect the status variables related to environments of the prime mover or the hydraulic pump and output the corresponding detected environment signals. In accordance with the detected environment signals, the environment modifying means modifies the fuel injection state of the fuel injection device controlled by the fuel injection control means or the pump maximum absorption torque controlled by the pump torque control means.

In the practical operation, depending on work sites and working conditions, changes of the conditions cannot be sufficiently adapted in some cases with the setting made at the time of designing the environment modifying means, such as occurred, for example, when the construction machine is operated under conditions outside the varying range of the environment factors which have been supposed at the time of designing the environment modifying means.

In such a case, according to the present invention, the alteration data for altering one or more computation (arithmetic operation) elements contained in at least one of the fuel injection control means, the pump torque control means and the environment modifying means is transmitted from the external terminal to the communication control means via information communication. Then, the computation element altering means properly alters (e.g., modifies, updates or rewrites) the computation elements based on the alteration data obtained by the communication control means. Thus, the computation elements, which have been once set and held on the construction machine side, can be altered with a subsequent external input. Therefore, even when the construction machine is operated under the working environments that cannot be sufficiently adapted with the setting made at the time of designing the environment modifying means, it is possible to appropriately modify the fuel injection state of the fuel injection device and the maximum absorption torque of the hydraulic pump, and to sufficiently develop the performance of the construction machine.

(2) In above (1), preferably, the environment modifying means is pump torque modifying means for modifying the maximum absorption torque of the hydraulic pump, which is controlled by the pump torque control means, in accordance with the detected environment signals by using a predetermined computation element for torque modification, the communication control means is means for obtaining alteration data for altering the computation element for torque modification, and the computation element altering means is means for altering the computation element for torque modification based on the obtained alteration data.

With those features, even when the construction machine is operated under the working environments that cannot be sufficiently adapted with the setting made at the time of designing the environment modifying means, the maximum absorption torque of the hydraulic pump can be appropriately modified by altering the computation element for torque modification, which is used in the pump torque modifying means, based on the alteration data obtained by the communication control means, and hence the performance of the construction machine can be sufficiently developed.

(3) In above (1), preferably, the environment modifying means is fuel injection modifying means for modifying the fuel injection state of the fuel injection device, which is controlled by the fuel injection control means, in accordance with the detected environment signals by using a predetermined computation element for injection modification, the communication control means is means for obtaining alteration data for altering the computation element for injection modification, and the computation element altering means is means for altering the computation element for injection modification based on the obtained alteration data.

With those features, even when the construction machine is operated under the working environments that cannot be sufficiently adapted with the setting made at the time of designing the environment modifying means, the fuel injection state of the fuel injection device can be appropriately modified by altering the computation element for injection modification, which is used in the fuel injection modifying means, based on the alteration data obtained by the communication control means, and hence the performance of the construction machine can be sufficiently developed.

(4) In above (1), preferably, the environment modifying means includes pump torque modifying means for modifying the maximum absorption torque of the hydraulic pump, which is controlled by the pump torque control means, in accordance with the detected environment signals by using a predetermined computation element for torque modification, and fuel injection modifying means for modifying the fuel injection state of the fuel injection device, which is controlled by the fuel injection control means, in accordance with the detected environment signals by using a predetermined computation element for injection modification, the communication control means is means for obtaining alteration data for altering the computation element for torque modification and the computation element for injection modification, and the computation element altering means are means for altering the computation element for torque modification and the computation element for injection modification based on the obtained alteration data.

With those features, even when the construction machine is operated under the working environments that cannot be sufficiently adapted with the setting made at the time of designing the environment modifying means, the maximum absorption torque of the hydraulic pump and the fuel injection state of the fuel injection device can be appropriately modified by altering the computation element for torque modification, which is used in the pump torque modifying means, and the computation element for injection modification, which is used in the fuel injection modifying means, based on the alteration data obtained by the communication control means, and hence the performance of the construction machine can be sufficiently developed.

(5) In above (1), preferably, the pump torque control means is means for controlling the maximum absorption torque of the hydraulic pump based on the target revolution speed and the actual revolution speed by using a predetermined computation element for torque control, the communication control means is means for obtaining alteration data for altering the computation element for torque control, and the computation element altering means is means for altering the computation element for torque control based on the obtained alteration data.

With those features, even when the construction machine is operated under the working environments that cannot be sufficiently adapted with the setting made at the time of designing the environment modifying means, the maximum absorption torque of the hydraulic pump can be appropriately modified by altering the computation element for torque control, which is used in the pump torque control means, based on the alteration data obtained by the communication control means, and hence the performance of the construction machine can be sufficiently developed.

(6) In above (1), preferably, the fuel injection control means is means for controlling the fuel injection state of the fuel injection device based on the target revolution speed and the actual revolution speed by using a predetermined computation element for injection control, the communication control means is means for obtaining alteration data for altering the computation element for injection control, and the computation element altering means is means for altering the computation element for injection control based on the obtained alteration data.

With those features, even when the construction machine is operated under the working environments that cannot be sufficiently adapted with the setting made at the time of designing the environment modifying means, the fuel injection state of the fuel injection device can be appropriately modified by altering the computation element for injection control, which is used in the fuel injection modifying means, based on the alteration data obtained by the communication control means, and hence the performance of the construction machine can be sufficiently developed.

(7) In above (1), preferably, the pump torque control means is means for controlling the maximum absorption torque of the hydraulic pump based on the target revolution speed and the actual revolution speed by using a predetermined computation element for torque control, the fuel injection control means is means for controlling the fuel injection state of the fuel injection device based on the target revolution speed and the actual revolution speed by using a predetermined computation element for injection control, the communication control means is means for obtaining alteration data for altering the computation element for torque control and the computation element for injection control, and the computation element altering means are means for altering the computation element for torque control and the computation element for injection control based on the obtained alteration data.

With those features, even when the construction machine is operated under the working environments that cannot be sufficiently adapted with the setting made at the time of designing the environment modifying means, the maximum absorption torque of the hydraulic pump and the fuel injection state of the fuel injection device can be appropriately modified by altering the computation element for torque control, which is used in the pump torque control means, and the computation element for injection control, which is used in the fuel injection control means, based on the alteration data obtained by the communication control means, and hence the performance of the construction machine can be sufficiently developed.

(8) In above (1), preferably, the signal processing system further comprises information collecting means for collecting various items of information including the detected environment signals from the environment detecting means, and the communication control means outputs the various items of information obtained by the information collecting means to the external terminal via communication.

With those features, appropriate alteration data for the computation elements can be selected or created on the external terminal side by using the environment information obtained from the detected environment signals.

(9) In above (8), preferably, the signal processing system further comprises operation detecting means for detecting status variables related to the operating state of the prime mover or the hydraulic pump and outputting corresponding detected signals, and the information collecting means is means for collecting various items of information including the detected environment signals from the environment detecting means and detected operation signals from the operation detecting means.

With those features, whether the computation elements have been appropriately altered or not can be monitored by using the operation information obtained from the detected operation signals.

(10) In above (1) to (9), preferably, the communication control means performs communication with respect to the external terminal via a communication line.

With that feature, the communication control means is able to conveniently perform communication with respect to the external terminal.

(11) In above (1) to (9), preferably, the communication control means is able to perform communication with respect to the external terminal in a wireless manner.

With that feature, the communication control means is able to perform communication with respect to even the external terminal in a remote location.

(12) In above (1), preferably, the environment detecting means are means for detecting at least one of environment factors including an intake pressure, an intake temperature, an exhaust temperature, an exhaust pressure, a cooling water temperature, a lubricant pressure and a lubricant temperature of the prime mover, an atmospheric pressure, a fuel temperature, and a hydraulic fluid temperature.

BRIEF DESCRIPTION OF THE DRAWINGS

FIG. 7 is a functional block diagram showing the processing function of modifying a maximum absorption torque of the hydraulic pumps, which is executed in a modification control unit of the machine body controller shown in FIG. 5.

BEST MODE FOR CARRYING OUT THE INVENTION

One embodiment of the present invention will be described below with reference to FIGS. 1 to 10. In the following embodiment, the present invention is applied to an engine/pump controller in a hydraulic excavator.

Figure 1:
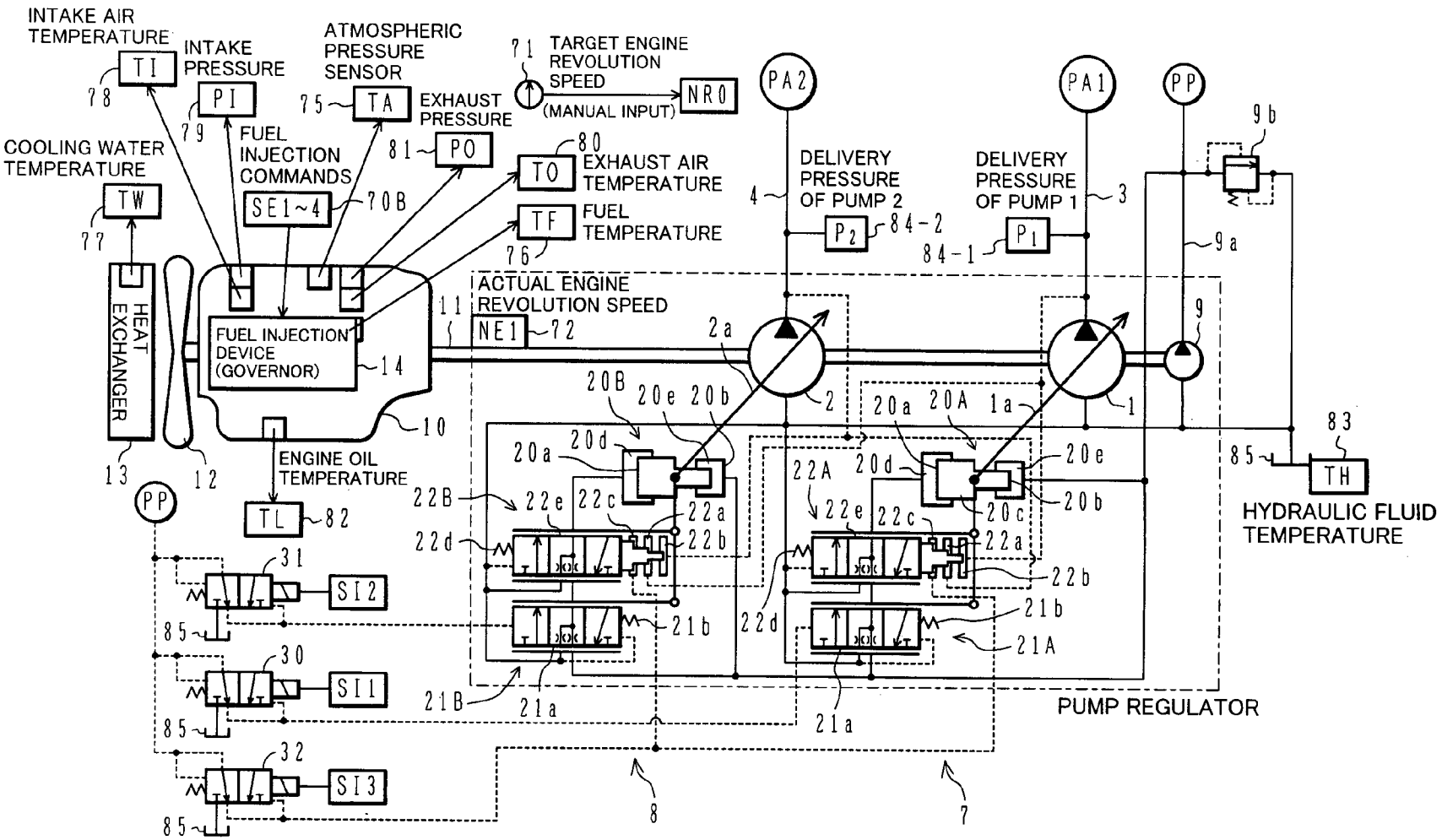
FIG. 1 is a hydraulic circuit diagram showing a part of a hydraulic drive system equipped in a hydraulic excavator to which a signal processing system for a construction machine according to the present invention is applied.

FIG. 1 is a hydraulic circuit diagram showing a part of a hydraulic drive system equipped in a hydraulic excavator to which a signal processing system for a construction machine according to the present invention is applied. In FIG. 1, numerals 1 and 2 denote variable displacement hydraulic pumps of, e.g., swash plate type. A valve unit 5 (see FIG. 2 described later) is connected to delivery lines 3, 4 of the hydraulic pumps 1, 2. A hydraulic fluid is sent to a plurality of hydraulic actuators 50 to 56 through the valve unit 5 for driving the actuators.

Numeral 9 denotes a fixed displacement pilot pump. A pilot relief valve 9*b* for holding the delivery pressure of the pilot pump 9 at a constant pressure is connected to a delivery line 9*a* of the pilot pump 9.

The hydraulic pumps 1, 2 and the pilot pump 9 are connected to an output shaft 11 of a prime mover 10 and are rotationally driven by the prime mover 10. Numeral 12 denotes a cooling fan, and 13 denotes a heat exchanger.

Figure 2:
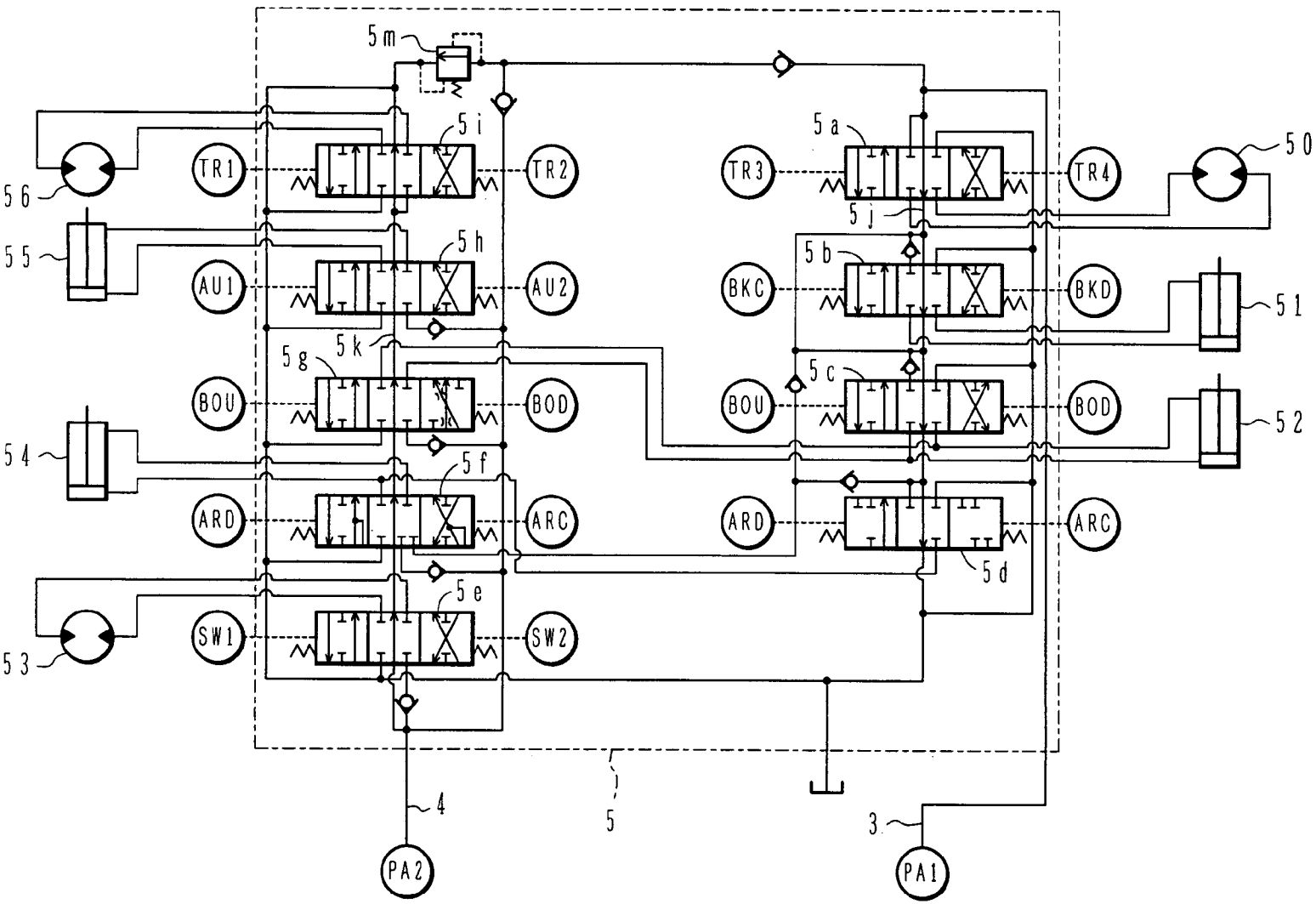
FIG. 2 is a hydraulic circuit diagram showing the construction of a valve unit equipped in the hydraulic excavator to which the signal processing system for the construction machine according to the present invention is applied.

FIG. 2 is a hydraulic circuit diagram showing the construction of the valve unit 5 equipped in the hydraulic excavator to which the signal processing system for the construction machine according to the present invention is applied. In FIG. 2, the valve unit 5 comprises two valve groups, i.e., control valves 5*a* to 5*d* and control valves 5*e* to 5*i*. The control valves 5*a* to 5*d* are positioned on a center bypass line 5*j* connected to the delivery line 3 of the hydraulic pump 1, and the control valves 5*e* to 5*i* are positioned on a center bypass line 5*k* connected to the delivery line 4 of the hydraulic pump 2. A main relief valve 5*m* for determining a maximum value of the delivery pressure of the hydraulic pumps 1, 2 is disposed in the delivery lines 3, 4.

The control valves 5*a* to 5*d* and the control valves 5*e* to 5*i* are each of center bypass type. The hydraulic fluid delivered from the hydraulic pumps 1, 2 is supplied to corresponding one or more of the hydraulic actuators 50 to 56 through the control valve(s). The actuator 50 serves as a hydraulic motor for traveling on the right side (i.e., a right travel motor), and the actuator 51 serves as a hydraulic cylinder for a bucket (i.e., a bucket cylinder). The actuator 52 serves as a hydraulic cylinder for a boom (i.e., a boom cylinder), and the actuator 53 serves as a hydraulic motor for a swing (i.e., a swing motor). The actuator 54 serves as a hydraulic cylinder for an arm (i.e., an arm cylinder), the actuator 55 serves as a backup hydraulic cylinder, and the actuator 56 serves as a hydraulic motor for traveling on the left side (left travel motor). The control valve 5*a* is a right travel control valve, and the control valve 5*b* is a bucket control valve. The control valve 5*c* is a first boom control valve, and the control valve 5*d* is a second arm control valve. The control valve 5*e* is a swing control valve, and the control valve 5*f* is a first arm control valve. The control valve 5*g* is a second boom control valve, the control valve 5*h* is a backup control valve, and the control valve 5*i* is a left travel control valve. Thus, two control valves 5*g*, 5*c* are provided for the boom cylinder 52 and two control valves 5*d*, 5*f* are provided for the arm cylinder 54 so that the hydraulic fluids delivered from the two hydraulic pumps 1, 2 can be supplied to the bottom sides of the boom cylinder 52 and the arm cylinder 54 in a joined way.

Figure 3:
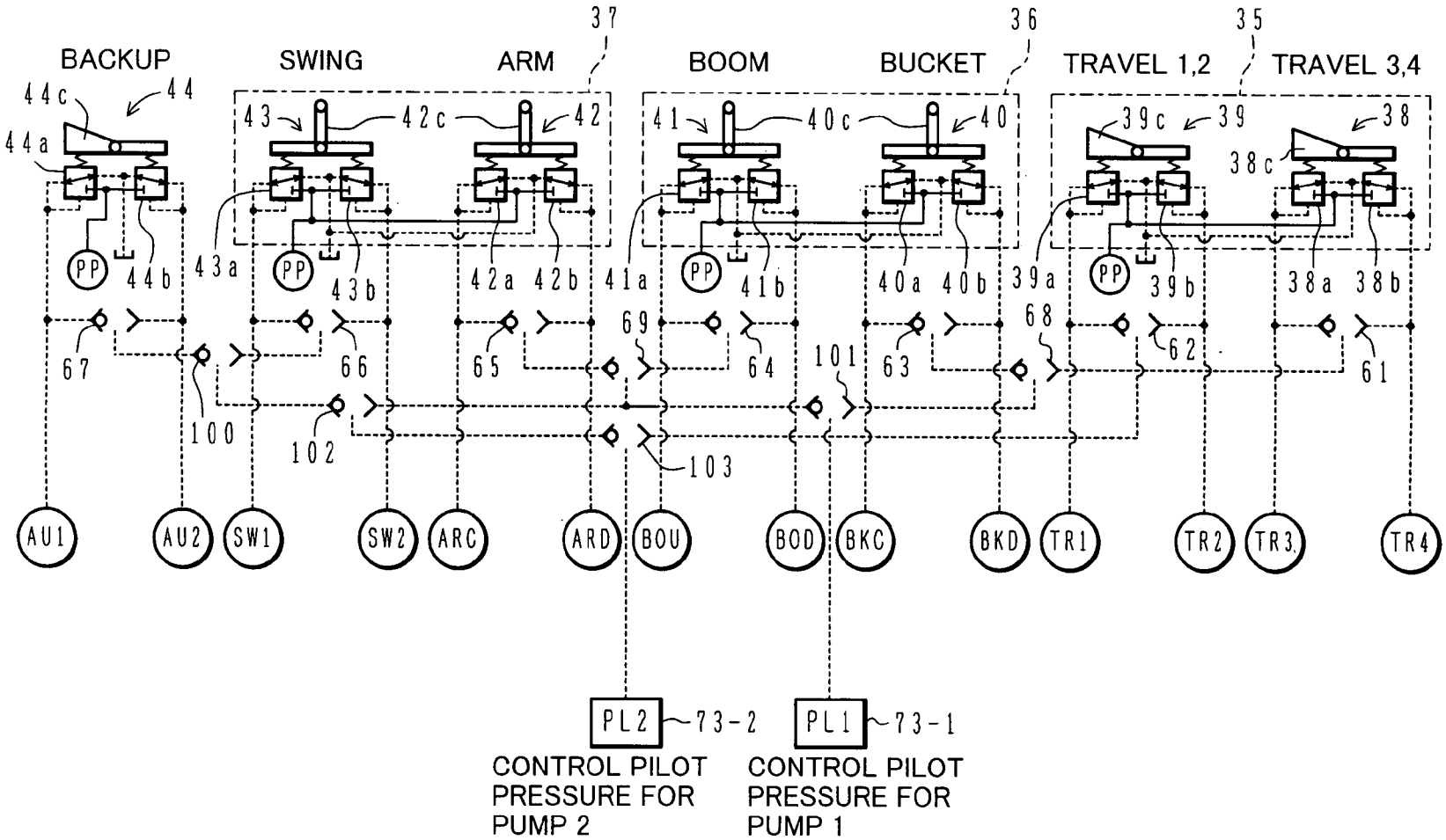
FIG. 3 is a hydraulic circuit diagram showing an operation pilot system for control valves equipped in the hydraulic excavator to which the signal processing system for the construction machine according to the present invention is applied.

FIG. 3 is a hydraulic circuit diagram showing an operation pilot system for the control valves 5*a* to 5*i* equipped in the hydraulic excavator to which the signal processing system for the construction machine according to the present invention is applied.

As shown in FIG. 3, the control valves 5*i*, 5*a* are shifted respectively by operation pilot pressures TR1, TR2 and operation pilot pressures TR3, TR4 from operation pilot units 39, 38 of an operating device 35. The control valve 5*b* and the control valves 5*c*, 5*g* are shifted respectively by operation pilot pressures BKC, BKD and operation pilot pressures BOD, BOU from operation pilot units 40, 41 of an operating device 36. The control valves 5*d*, 5*f* and the control valve 5*e* are shifted respectively by operation pilot pressures ARC, ARD and operation pilot pressures SW1, SW2 from operation pilot units 42, 43 of an operating device 37. The control valve 5*h* is shifted by operation pilot pressures AU1, AU2 from an operation pilot unit 44.

The operation pilot units 38 to 44 include pairs of pilot valves (pressure reducing valves) 38*a*, 38*b* to 44*a*, 44*b*, respectively. Further, the operation pilot units 38, 39 and 44 include control pedals 38*c*, 39*c* and 44*c*, respectively, the operation pilot units 40, 41 include a common control lever 40*c*, and the operation pilot units 42, 43 include a common control lever 42*c*. When any of the control pedals 38*c*, 39*c* and 44*c* and the control levers 40*c*, 42*c* is manipulated, the pilot valve of the corresponding operation pilot unit is operated depending on the direction of the manipulation and the operation pilot pressure is produced depending on the amount by which the pedal or the lever has been manipulated.

Further, shuttle valves 61 to 67 are connected to output lines of the respective pilot valves of the operation pilot units 38 to 44. Other shuttle valves 68, 69 and 100 to 103 are connected to the shuttle valves 61 to 67 in a hierarchical arrangement. The shuttle valves 61, 63, 64, 65, 68, 69 and 101 detect, as a control pilot pressure PL1 for the hydraulic pump 1, a maximum one of the operation pilot pressures from the operation pilot units 38, 40, 41 and 42. The shuttle valves 62, 64, 65, 66, 67, 69, 100, 102 and 103 detect, as a control pilot pressure PL2 for the hydraulic pump 2, a maximum one of the operation pilot pressures from the operation pilot units 39, 41, 42, 43 and 44.

The engine/pump controller including the signal processing system for the construction machine according to the present invention is disposed in the hydraulic drive system described above. Details of the engine/pump controller will be described below.

Returning to FIG. 1, the hydraulic pumps 1, 2 are provided with regulators 7, 8, respectively. These regulators 7, 8 control tilting positions of swash plates 1*a*, 2*a*, which constitute displacement varying mechanisms of the hydraulic pumps 1, 2, thereby controlling respective pump delivery rates.

The regulators 7, 8 for the hydraulic pumps 1, 2 comprise, respectively, tilting actuators 20A, 20B (also denoted by representative number 20 hereinafter), first servo valves 21A, 21B (also denoted by representative number 21 hereinafter) for performing positive tilting control based on the operation pilot pressures from the operation pilot units 38 to 44 shown in FIG. 3, and second servo valves 22A, 22B (also denoted by representative number 22 hereinafter) for performing total horsepower control of the hydraulic pumps 1, 2. Those servo valves 21, 22 control the pressure of a hydraulic fluid supplied from the pilot pump 9 and acting upon the tilting actuators 20, whereby the tilting positions of the hydraulic pumps 1, 2 are controlled.

Each tilting actuator 20 comprises an operating piston 20*c* having a larger-diameter pressure bearing portion 20*a* and a smaller-diameter pressure bearing portion 20*b* formed at opposite ends thereof, and pressure bearing chambers 20*d*, 20*e* in which the pressure bearing portions 20*a*, 20*b* are positioned respectively. When the pressures in both the pressure bearing portions 20*d*, 20*e* are equal to each other, the operating piston 20*c* is moved to the right on the drawing, whereby the tilting of the swash plate 1*a* or 2*a* is reduced and the pump delivery rate is also reduced. When the pressure in the pressure bearing chamber 20*d* on the larger-diameter side lowers, the operating piston 20*c* is moved to the left on the drawing, whereby the tilting of the swash plate 1*a* or 2*a* is increased and the pump delivery rate is also increased. Further, the pressure bearing chamber 20*d* on the larger-diameter side is connected to the delivery line 9*a* of the pilot pump 9 through the first and second servo valves 21, 22, while the pressure bearing chamber 20*e* on the smaller-diameter side is directly connected to the delivery line 9*a* of the pilot pump 9.

The first servo valves 21 for the positive tilting control are valves operated by respective control pressures from solenoid control valves 30, 31 and controlling the tilting positions of the hydraulic pumps 1, 2. When the control pressure is high, a valve member 21*a* is moved to the right on the drawing, whereby the pilot pressure from the pilot pump 9 is transmitted to the pressure bearing chamber 20*d* without being reduced and the tilting of the hydraulic pump 1 or 2 is reduced. As the control pressure lowers, the valve member 21*a* is moved to the left on the drawing by the force of a spring 21*b*, whereby the pilot pressure from the pilot pump 9 is transmitted to the pressure bearing chamber 20*d* after being reduced and the tilting of the hydraulic pump 1 or 2 is increased.

The second servo valves 22 for the total horsepower control are valves operated by the delivery pressures of the hydraulic pumps 1, 2 and a control pressure from a solenoid control valve 32 and performing the total horsepower control for the hydraulic pumps 1, 2. The solenoid control valve 32 controls a maximum absorption torque of the hydraulic pumps 1, 2 in a limiting manner.

More specifically, the delivery pressures of the hydraulic pumps 1, 2 and the control pressure from the solenoid control valve 32 are introduced respectively to pressure bearing chambers 22*a*, 22*b* and 22*c* of a driving sector. When the sum of hydraulic forces of the delivery pressures of the hydraulic pumps 1, 2 is smaller than a setting value determined by a difference between the resilient force of a spring 22*d* and the hydraulic force of the control pressure introduced to the pressure bearing chamber 22*c*, a valve member 22*e* is moved to the right on the drawing, whereby the pilot pressure from the pilot pump 9 is transmitted to the pressure bearing chamber 20*d* without being reduced and the tilting of the hydraulic pump 1 or 2 is reduced. As the sum of hydraulic forces of the delivery pressures of the hydraulic pumps 1, 2 becomes higher than the setting value, the valve member 22*a* is moved to the left on the drawing, whereby the pilot pressure from the pilot pump 9 is transmitted to the pressure bearing chamber 20*d* after being reduced and the tilting of the hydraulic pump 1 or 2 is increased. Also, when the control pressure from the solenoid control valve 32 is low, the setting value is increased so that the tilting of the hydraulic pump 1 or 2 starts to reduce from a relatively high level of the delivery pressure of the hydraulic pump 1 or 2. As the control pressure from the solenoid control valve 32 becomes higher, the setting value is reduced so that the tilting of the hydraulic pump 1 or 2 starts to reduce from a relatively low level of the delivery pressure of the hydraulic pump 1 or 2.

The solenoid control valves 30, 31 and 32 are proportional pressure reducing valves operated by drive currents S11, S12 and S13, respectively. The solenoid control valves 30, 31 and 32 operate such that when the drive currents S11, S12 and S13 are at minimum, they output maximum control pressures, and as the drive currents S11, S12 and S13 increase, the outputted control pressures lower. The drive currents S11, S12 and S13 are outputted from a machine body controller 70A described later.

The prime mover 10 is a diesel engine and is provided with a fuel injection device 14. The fuel injection device 14 controls the fuel injection volume, the fuel injection timing, the fuel injection pressure, the fuel injection rate, etc. in accordance with command signals SE1_CSE2, SE3 and SE4 (described later) from an engine controller 70B, thereby controlling the revolution speed of the prime mover 10 to be held at a target engine revolution speed NR1 which is outputted from the machine body controller 70A. Though not shown in detail, the fuel injection device includes an injection pump and a governor mechanism per cylinder of the prime mover 10.

The injection pump pressurizes fuel by a plunger being pushed up with rotation of a camshaft in interlock with a crankshaft of the prime mover 10 (the fuel pressure produced at this time is decided depending on a setting relief pressure of a variable relief valve in the form of, e.g., a solenoid proportional valve, which is driven by a fuel injection pressure command signal SE3 described later). The pressurized fuel is injected into the engine cylinder through an injection nozzle. Stated another way, the fuel injection pressure can be controlled in accordance with the command signal SE3.

On that occasion, the governor mechanism controls the position of a link mechanism by a governor actuator which is driven by a fuel injection volume command signal SE1 described later, thereby changing the effective compression stroke of the plunger. As a result, the fuel injection volume is adjusted. Stated another way, the fuel injection volume can be controlled in accordance with the command signal SE1. Further, the camshaft can be advanced in angle relative to the rotation of the crankshaft by a timer actuator, for example, for phase adjustment, thereby adjusting the fuel injection timing. The timer actuator incorporates therein a hydraulic actuator supplied with a hydraulic fluid at a flow rate that is controlled by, e.g., a solenoid proportional valve driven by a fuel injection timing command signal SE2 described later. As a result, the fuel injection timing can be controlled in accordance with the command signal SE2. Though not described in detail here, the fuel injection rate can also be similarly controlled in accordance with a fuel injection rate command signal SE4.

The foregoing description of the governor mechanism for the fuel injection device is made in connection with, by way of example, the so-called mechanical governor controller wherein a motor is coupled to a governor lever of a mechanical fuel injection pump and the motor is driven to a predetermined position in accordance with a command value so as to hold the target engine revolution speed, thereby controlling the position of the governor lever. However, the fuel injection device 14 of this embodiment is also effective for an electronic governor controller which is controlled in accordance with an input electrical signal corresponding to the target engine revolution speed.

Figure 4:
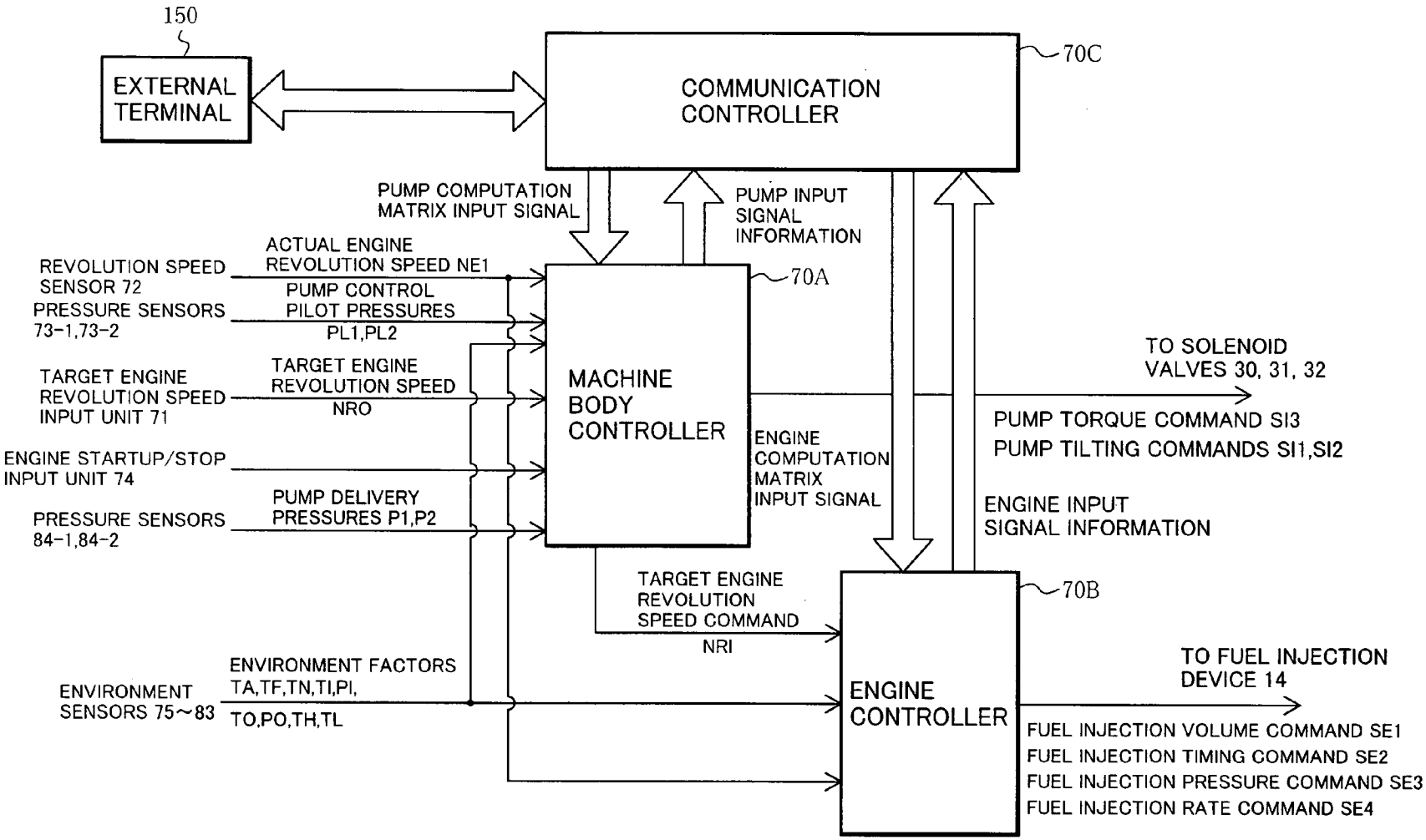
FIG. 4 is a conceptual diagram showing a flow of signal processing as a principal part of one embodiment of the signal processing system for the construction machine according to the present invention.

The prime mover 10 is provided with a target engine revolution speed input unit 71 through which an operator manually inputs a target engine revolution speed NR0. An input signal representative of the target engine revolution speed NR0 is taken into the machine body controller 70A as shown in FIG. 4 described later. The machine body controller 70A outputs a command signal for the target revolution speed NR1 to the engine controller 70B. Further, the corresponding command signals SE1 to SE4 are inputted to the fuel injection device 14, whereby the revolution speed of the prime mover 10 is controlled (details of this control will be described later). The target engine revolution speed input unit 71 may be an electrical input means, such as a potentiometer, for direct inputting to the machine body controller 70A. In this case, the operator selects the magnitude of the engine revolution speed, which serves as a reference. Additionally, startup (activation) and stop of the prime mover 10 is instructed from an engine startup/stop input unit 74 (see FIG. 4 described later).

Also, there are provided a revolution speed sensor 72 for detecting an actual revolution speed NE1 of the prime mover 10, pressure sensors 73-1, 73-2 (see FIG. 3) for detecting the control pilot pressures PL1, PL2 of the hydraulic pumps 1, 2, and pressure sensors 84-1, 84-2 for detecting the delivery pressures P1, P2 of the hydraulic pumps 1, 2.

Further, an atmospheric pressure sensor 75, a fuel temperature sensor 76, a cooling water temperature sensor 77, an intake temperature sensor 78, an intake pressure sensor 79, an exhaust temperature sensor 80, an exhaust pressure sensor 81, an engine oil temperature sensor 82, and a hydraulic fluid temperature sensor 83 associated with a hydraulic reservoir 85 are provided as sensors for detecting the environments of the prime mover 10 and the hydraulic pumps 1, 2, and they output respectively an atmospheric pressure sensor signal TA, a fuel temperature sensor signal TF, a cooling water temperature sensor signal TW, an intake temperature sensor signal TI, an intake pressure sensor signal PI, an exhaust temperature sensor signal TO, an exhaust pressure sensor signal PO, an engine oil temperature sensor signal TL, and a hydraulic fluid temperature sensor signal TH.

FIG. 4 is a conceptual diagram showing a flow of signal processing as a principal part of one embodiment of the signal processing system for the construction machine according to the present invention. In FIG. 4, the signal processing system of this embodiment comprises the machine body controller 70A for primarily performing control of the hydraulic pumps 1, 2, the engine controller 70B for primarily performing control of the prime mover 10, and a communication controller 70C which is connected to the machine body controller 70A and the engine controller 70B in a communicable manner inside the hydraulic excavator, and which transfers various signals with respect to an external terminal 150 via information communication.

(A) Machine Body Controller 70A

Figure 5:
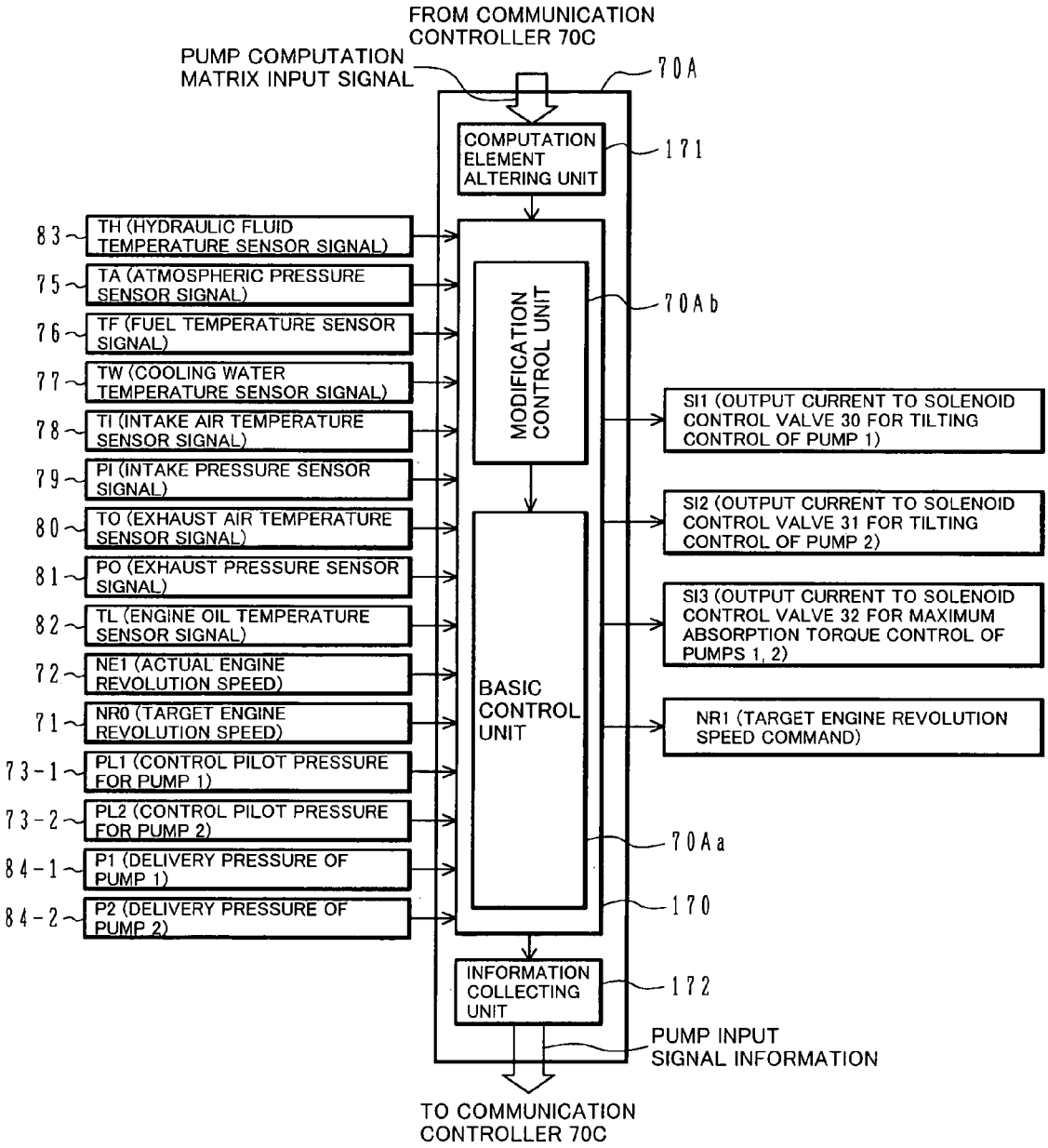
FIG. 5 is a functional block diagram showing the input/output relationships of all signals for a machine body controller constituting one embodiment of the signal processing system for the construction machine according to the present invention.

FIG. 5 is a functional block diagram showing the input/output relationships of all signals for the machine body controller 70A constituting one embodiment of the signal processing system for the construction machine according to the present invention.

In FIG. 5, the machine body controller 70A comprises a pump control unit 170, a computation element altering unit 171, and an information collecting unit 172. The pump control unit 170 comprises a basic control unit 70Aa and a modification control unit 70Ab.

In the pump control unit 170, the basic control unit 70Aa receives a signal of the target engine revolution speed NR0 from the target engine revolution speed input unit 71, a signal of the actual revolution speed NE1 from the revolution speed sensor 72, signals of the pump control pilot pressures PL1, PL2 from the pressure sensors 73-1, 73-2, signals of the pump delivery pressures P1, P2 from the pressure sensors 84-1, 84-2, and a modification value of the pump maximum absorption torque (torque modification value ΔTFL) from the modification control unit 70Ab. Then, the basic control unit 70Aa executes predetermined processing (described later in detail) and outputs the drive currents SI1, SI2 and SI3 to the solenoid control valves 30 to 32, thereby controlling the tilting positions of the hydraulic pumps 1, 2, i.e., the pump delivery rates. As an auxiliary function, the basic control unit 70Aa receives the signal of the target engine revolution speed NR0 from the target engine revolution speed input unit 71, as described above, and outputs a signal of the target revolution speed NR1 to the engine controller 70B. With this auxiliary function, when the prime mover 10 is provided with a known engine revolution modifying means, e.g., an automatic accelerating device or an automatic idling device which is operated upon manipulation of a mode selecting means, a value obtained by modifying the target revolution speed NR0 can be set as the target revolution speed NR1. When any engine revolution speed modifying means is not provided, NR0 may be used as it is, i.e., NR1=NR0.

The modification control unit 70Ab receives the signals from the environment sensors 75 to 83 mentioned above, i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH. Then, the modification control unit 70Ab executes predetermined processing (described later in detail) to compute the torque modification value ΔTFL and outputs the computed value to the basic control unit 70Aa, thereby modifying the pump maximum absorption torque.

Figure 6:
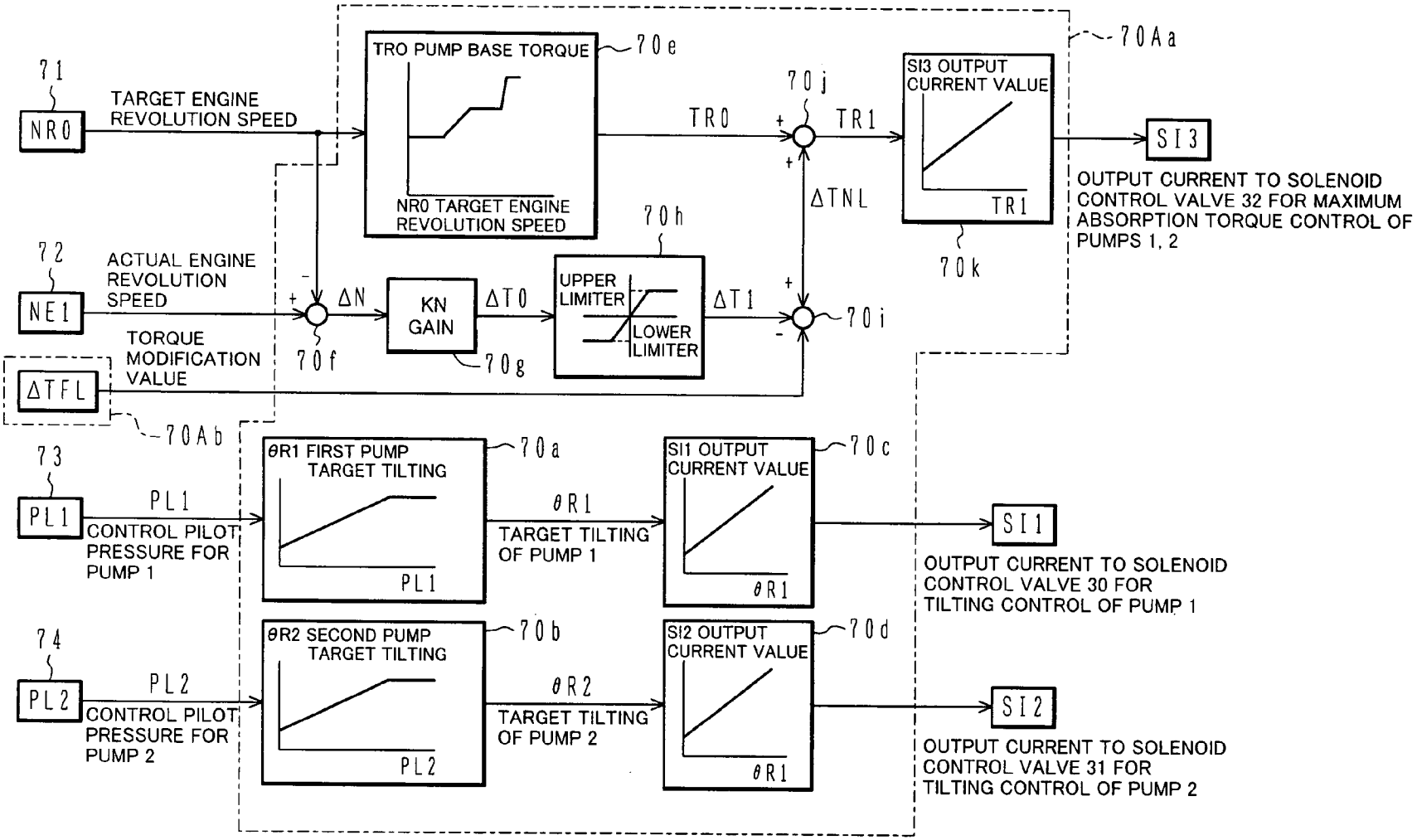
FIG. 6 is a functional block diagram showing the processing function related to control of hydraulic pumps, which is executed in a basic control unit of the machine body controller shown in FIG. 5.

FIG. 6 is a functional block diagram showing the processing function related to control of the hydraulic pumps 1, 2, which is executed in the basic control unit 70Aa of the machine body controller 70A, and FIG. 7 is a functional block diagram showing the processing function of the modification control unit 70Ab of the machine body controller 70A.

In FIGS. 6 and 7, the basic control unit 70Aa has various functions executed by pump target tilting computing units 70*a*, 70*b*, solenoid output current computing units 70*c*, 70*d*, a base torque computing unit 70*e*, a revolution speed deviation computing unit 70*f*, a torque converting unit 70*g*, a limiter computing unit 70*h*, a speed-sensing torque deviation modifying unit 70*i*, a base torque modifying unit 70*j*, and a solenoid output current computing unit 70*k*. Also, the modification control unit 70Ab has various functions executed by modification gain computing units 70*m*1 to 70*v*1 and a torque modification value computing unit 70*w*1.

In FIG. 6 showing the basic control unit 70Aa, the pump target tilting computing unit 70*a* receives the signal of the control pilot pressure PL1 on the side of the hydraulic pump 1 and computes a target tilting θR1 of the hydraulic pump 1 corresponding to the control pilot pressure PL1 at that time by referring to a table as shown, which is stored in a memory. The target tilting θR1 represents metering of a reference flow rate in positive tilting control with respect to the amounts by which the pilot operating devices 38, 40, 41 and 42 have been manipulated. In the table stored in the memory, the relationship of PL1 and θR1 is, set such that as the control pilot pressure PL1 becomes higher, the target tilting θR1 also increases.

The solenoid output current computing unit 70*c* refers to a table as shown with respect to θR1, determines the drive current SI1, which provides θR1, for tilting control of the hydraulic pump 1, and outputs the drive current SI1 to the solenoid control valve 30.

Similarly, in the pump target tilting computing unit 70*b* and the solenoid output current computing units 70*d*, the drive current SI2 for tilting control of the hydraulic pump 2 is computed from the signal of the pump control pilot pressure PL2 and then outputted to the solenoid control valve 31.

The base torque computing unit 70*e* receives the signal of the target engine revolution speed NR0 and computes a pump base torque TR0 corresponding to the target engine revolution speed NR0 at that time by referring to a table as shown, which is stored in a memory. In the table stored in the memory, the relationship of NR0 and TR0 is set such that as the target engine revolution speed NR0 rises, the pump base torque TR0 also increases.

The revolution speed deviation computing unit 70*f* computes a revolution speed deviation ΔN, i.e., a difference between the target engine revolution speed NR0 and the actual engine revolution speed NE1.

The torque converting unit 70*g* multiples the revolution speed deviation ΔN by a speed sensing gain KN to compute a speed-sensing torque deviation ΔT0.

The limiter computing unit 70*h* applies upper and lower limiters to the speed-sensing torque deviation ΔT0, thereby obtaining a speed-sensing torque deviation ΔT1.

The speed-sensing torque deviation modifying unit 70*i* subtracts the torque modification value ΔTFL, which is determined through later-described processing shown in FIG. 7, from the speed-sensing torque deviation ΔT1, thereby obtaining a torque deviation ΔTNL.

The base torque modifying unit 70*j* adds the torque deviation ΔTNL to the pump base torque TR0 computed in the base torque computing unit 70*e*, thereby obtaining an absorption torque TR1. This TR1 is used as a target maximum absorption torque of the hydraulic pumps 1, 2.

The solenoid output current computing unit 70*k* refers to a table as shown with respect to TR1, determines the drive current SI3 of the solenoid control valve 32, which provides TR1, for controlling the maximum absorption torque of the hydraulic pumps 1, 2, and outputs the drive current SI3 to the solenoid control valve 32.

On the other hand, in FIG. 7 showing the modification control unit 70Ab, the modification gain computing unit 70*m*1 receives the atmospheric pressure sensor signal TA and computes a first modification gain K1TA corresponding to the atmospheric pressure sensor signal TA at that time by referring to a table stored in a memory. The first modification gain K1TA represents a value that has been determined and stored beforehand in consideration of characteristics of the engine itself. Other modification gains, described below, are also determined and stored in a similar way. The engine output reduces as the atmospheric pressure lowers. Therefore, the relationship between the atmospheric pressure sensor signal TA and the first modification gain K1TA is set in the table stored in the memory so as to compensate for such a tendency.

The modification gain computing unit 70*n*1 receives the fuel temperature sensor signal TF and computes a first modification gain K1TF corresponding to the fuel temperature sensor signal TF at that time by referring to a table stored in a memory. The engine output reduces when the fuel temperature is low or high. Therefore, the relationship between the fuel temperature sensor signal TF and the first modification gain K1TF is set in the table stored in the memory so as to compensate for such a tendency.

The modification gain computing unit 70*p*1 receives the cooling water temperature sensor signal TW and computes a first modification gain K1TW corresponding to the cooling water temperature sensor signal TW at that time by referring to a table stored in a memory. The engine output reduces when the cooling water temperature is low or high. Therefore, the relationship between the cooling water temperature sensor signal TW and the first modification gain K1TW is set in the table stored in the memory so as to compensate for such a tendency.

The modification gain computing unit 70*q*1 receives the intake temperature sensor signal TI and computes a first modification gain K1TI corresponding to the intake temperature sensor signal TI at that time by referring to a table stored in a memory. The engine output reduces when the intake temperature is low or high. Therefore, the relationship between the intake temperature sensor signal TI and the first modification gain K1TI is set in the table stored in the memory so as to compensate for such a tendency.

The modification gain computing unit 70*r*1 receives the intake pressure sensor signal PI and computes a first modification gain K1PI corresponding to the intake pressure sensor signal PI at that time by referring to a table stored in a memory. The engine output reduces when the intake pressure is low or high. Therefore, the relationship between the intake pressure sensor signal PI and the first modification gain K1PI is set in the table stored in the memory so as to compensate for such a tendency.

The modification gain computing unit 70*s*1 receives the exhaust temperature sensor signal TO and computes a first modification gain K1TO corresponding to the exhaust temperature sensor signal TO at that time by referring to a table stored in a memory. The engine output reduces when the exhaust temperature is low or high. Therefore, the relationship between the exhaust temperature sensor signal TO and the first modification gain K1TO is set in the table stored in the memory so as to compensate for such a tendency.

The modification gain computing unit 70*t*1 receives the exhaust pressure sensor signal PO and computes a first modification gain K1PO corresponding to the exhaust pressure sensor signal PO at that time by referring to a table stored in a memory. The engine output reduces as the exhaust pressure rises. Therefore, the relationship between the exhaust pressure sensor signal PO and the first modification gain K1PO is set in the table stored in the memory so as to compensate for such a tendency.

The modification gain computing unit 70*u*1 receives the engine oil temperature sensor signal TL and computes a first modification gain K1TL corresponding to the engine oil temperature sensor signal TL at that time by referring to a table stored in a memory. The engine output reduces when the engine oil temperature is low or high. Therefore, the relationship between the engine oil temperature sensor signal TL and the first modification gain K1TL is set in the table stored in the memory so as to compensate for such a tendency.

The modification gain computing unit 70*v*1 receives the hydraulic fluid temperature sensor signal TH and computes a first modification gain K1TH corresponding to the hydraulic fluid temperature sensor signal TH at that time by referring to a table stored in a memory. The engine output reduces when the hydraulic fluid temperature is low or high. Therefore, the relationship between the hydraulic fluid temperature sensor signal TH and the first modification gain K1TH is set in the table stored in the memory so as to compensate for such a tendency.

The torque modification value computing unit 70*w*1 computes the torque modification value ΔTFL by applying respective weights to the first modification gains computed in the modification gain computing units 70*m*1 to 70*v*1. A computing process is as follows. For the specific performance of the engine, the amounts by which the engine output reduces with the respective modification gains are determined in advance, and a reference torque modification value ΔTB for the torque modification value ΔTFL to be computed is stored as a constant in the unit 70*w*1. Further, the respective weights to be applied to the modification gains are determined in advance, and modification amounts based on the respective weights are stored, as a matrix of A, B, C, D, E, F, G, H and I in the modification control unit 70Ab of the machine body controller. By using those values, the torque modification value ΔTFL is computed based on a calculation formula shown in the torque modification value computing block shown in FIG. 7.

Although the calculation formula shown in FIG. 7 is expressed as a linear equation, a similar effect is obtained by using a quadratic equation, for example, because any calculation formula is prepared with the same purpose of computing the final torque modification value ΔTFL.

The solenoid control valve 32 having received the drive current SI3 thus produced controls the maximum absorption torque of the hydraulic pumps 1, 2, as mentioned above.

Returning to FIG. 5, the computation element altering unit 171 receives computation elements (alteration data) for the torque modification from the outside of the machine body through the communication controller 70C, and alters (e.g., updates, modifies, or rewrites) the tables themselves, shown in FIG. 7, used in the modification gain computing units 70*m*1 to v1 of the modification control unit 70Ab, the computation matrix used in the torque modification value computing unit 70*w*1, other arithmetic operators (such as the constant ΔTB), etc.

The information collecting unit 172 collects various items of information including various detected environment signals (environment information) from the environment sensors 75 to 83 described above, i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH; various detected operation signals (operation information) inputted to the pump control unit 170 from the sensors 72, 73-1, 73-2, 84-1 and 84-2, i.e., the actual engine revolution speed NE1, the pump control pilot pressures PL1, PL2, and the hydraulic pump delivery pressures P1, P2; the manipulation signal (manipulation information), i.e., the target engine revolution speed NR0 inputted to the pump control unit 170 from the target engine revolution speed input unit 71; and computed values (internal computation information) such as the target tilting θR1, θR2 of the hydraulic pumps 1, 2 and the absorption torque TR1. Those items of information are collected, for example, by storing the information in a memory at the proper timing. The collected information is outputted to the outside of the machine body through the communication controller 70C.

(2) Engine Controller 70B

Figure 8:
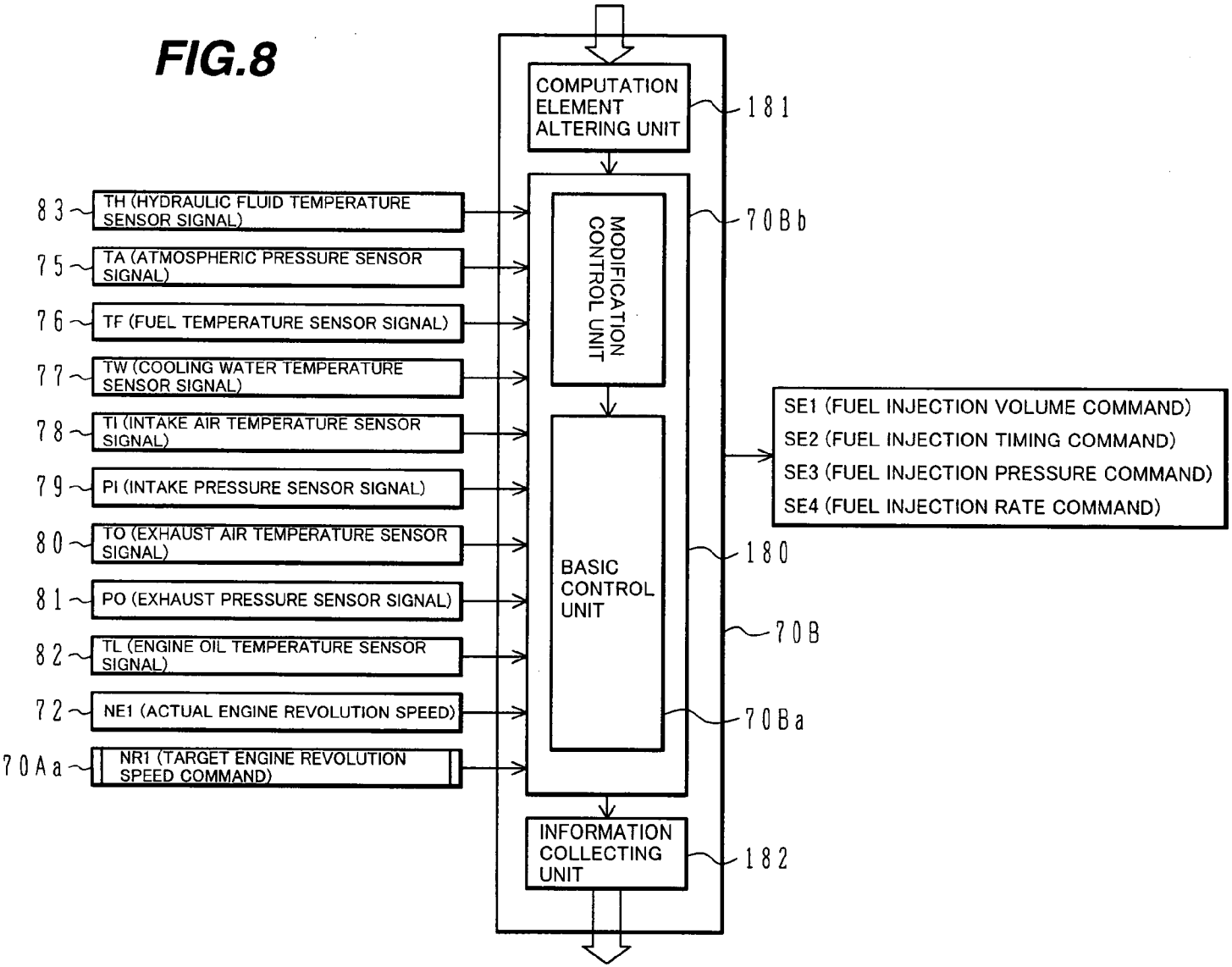
FIG. 8 is a functional block diagram showing the input/output relationships of all signals for an engine controller constituting one embodiment of the signal processing system for the construction machine according to the present invention.

FIG. 8 is a functional block diagram showing the input/output relationships of all signals for the engine controller 70B constituting one embodiment of the signal processing system for the construction machine according to the present invention. FIG. 8 corresponds to FIG. 5.

In FIG. 8, the engine controller 70B comprises an engine control unit 180, a computation element altering unit 181, and an information collecting unit 182. The engine control unit 180 comprises a basic control unit 70Ba and a modification control unit 70Bb.

In the engine control unit 180, the basic control unit 70Ba receives a signal of the target engine revolution speed command NR1 from the basic control unit 70Aa of the machine body controller, the signal of the actual revolution speed NE1 from the revolution speed sensor 72, and an environment modification value (injection modification value) ΔNFL for the fuel injection control from the modification control unit 70Bb. Then, the basic control unit 70Ba executes predetermined processing and outputs the above-mentioned drive currents (command signals) SE1, SE2, SE3 and SE4 to the fuel injection device 14, thereby controlling the fuel injection volume, the fuel injection timing, the fuel injection pressure, the fuel injection rate (including the so-called pilot injection in this embodiment).

The modification control unit 70Bb receives the signals from the environment sensors 75 to 83 mentioned above, i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH. Then, the modification control unit 70Bb executes predetermined processing (described later in detail) to compute the environment modification value (injection modification value) ΔNFL for the fuel injection control and outputs the computed value to the basic control unit 70Ba, thereby modifying the fuel injection control. The environment modification value (injection modification value) ΔNFL for the fuel injection control is a value that, when the environment changes in a direction in which the engine output reduces, it increases corresponding to the amount of change (as described later).

Figure 9:
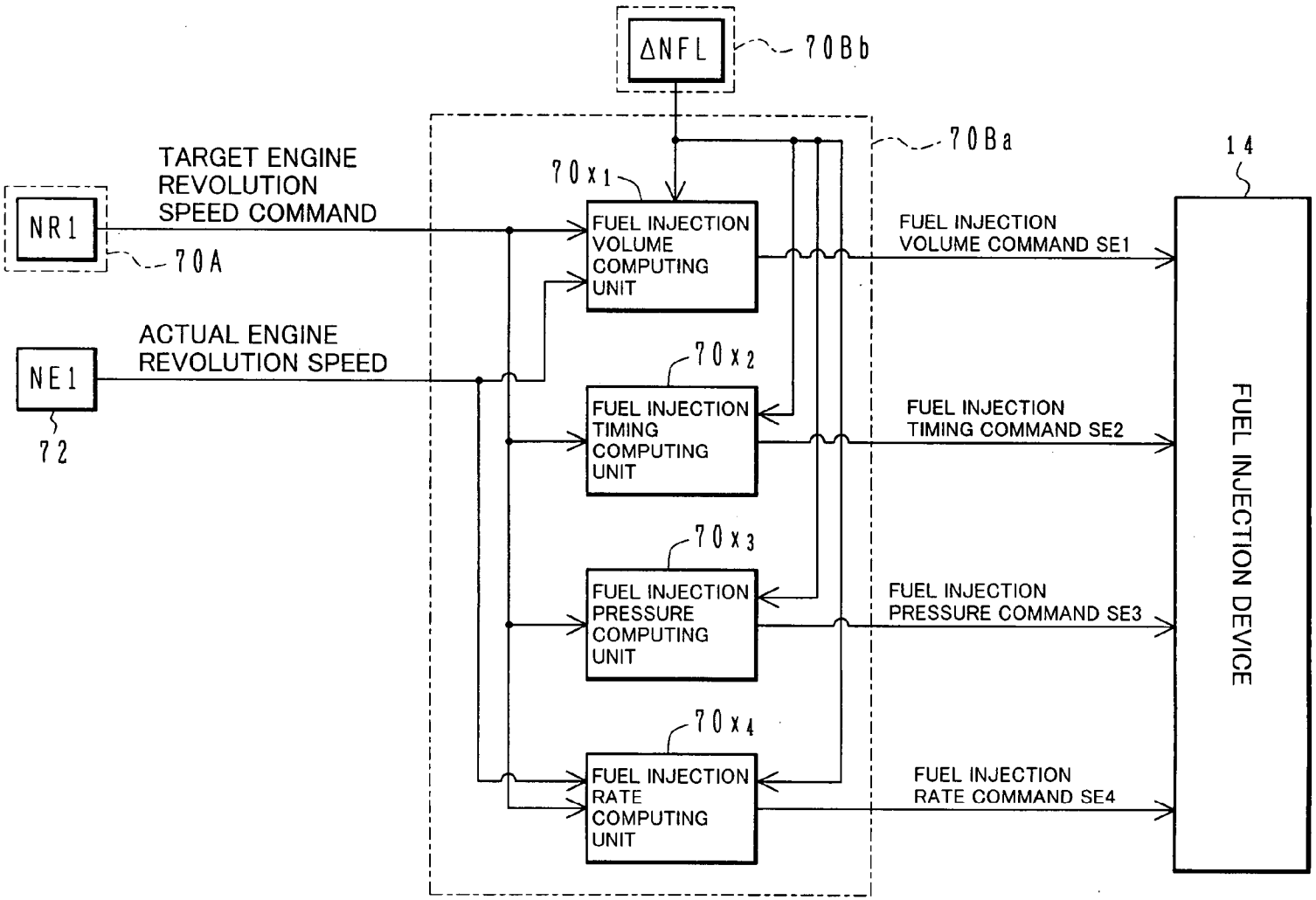
FIG. 9 is a functional block diagram showing the processing function related to fuel injection control, which is executed in a basic control unit of the engine controller shown in FIG. 8.
Figure 10:
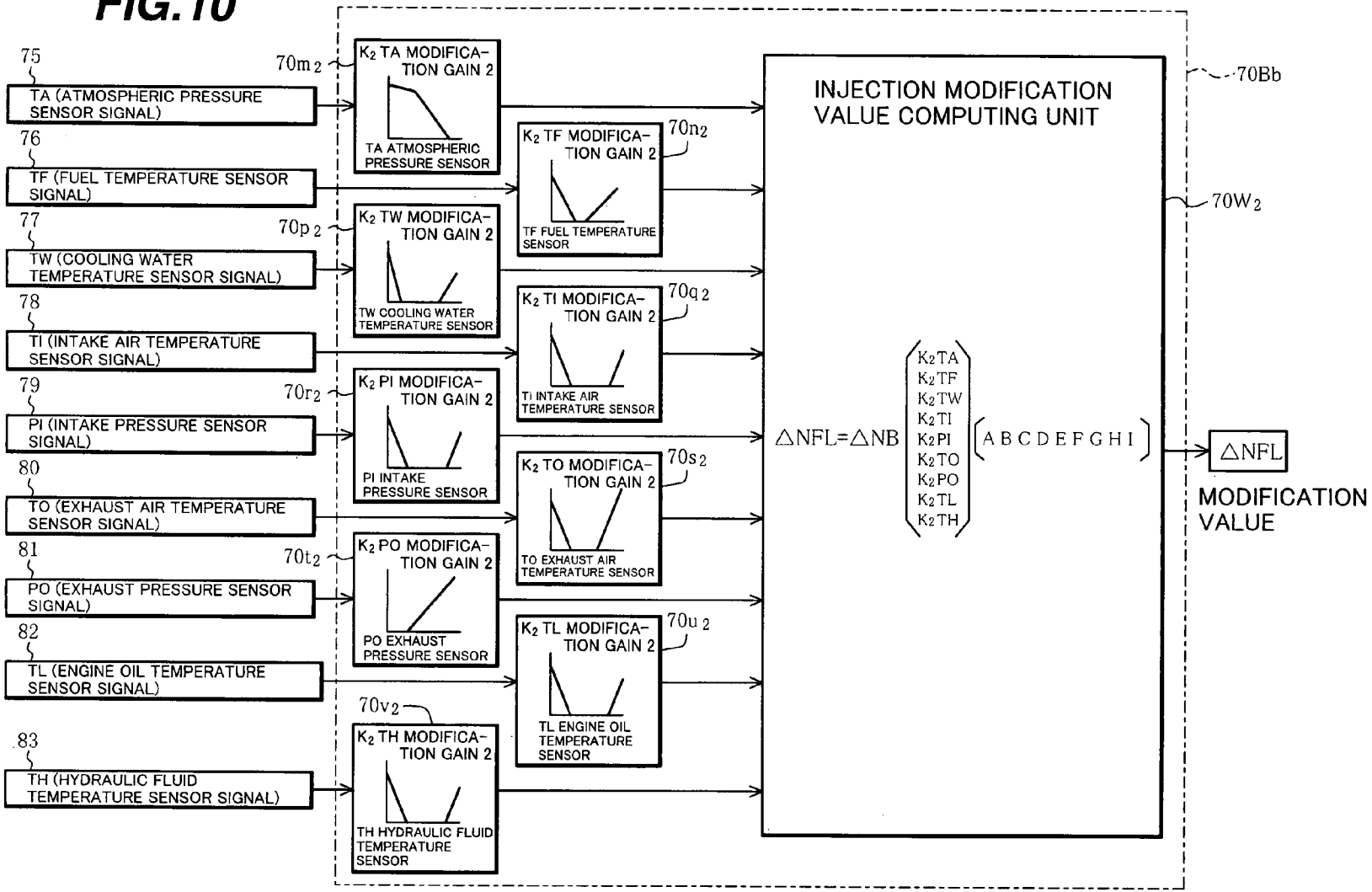
FIG. 10 is a functional block diagram showing the processing function of modifying fuel injection, which is executed in a modification control unit of the engine controller shown in FIG. 8.

FIG. 9 is a functional block diagram showing the processing function related to the fuel injection control, which is executed in the basic control unit 70Ba of the engine controller 70B, and FIG. 10 is a functional block diagram showing the processing function of computing injection modification value, which is executed in the modification control unit 70Bb of the engine controller 70B.

In FIGS. 9 and 10, the basic control unit 70Ba has various functions executed by a fuel injection volume computing unit 70*x*1, a fuel injection timing computing unit 70*x*2, a fuel injection pressure computing unit 70*x*3, and a fuel injection rate computing unit 70*x*4. Also, the modification control unit 70Bb has various functions executed by modification gain computing units 70*m*2 to 70*v*2 and an injection modification value computing unit 70*w*2.

In FIG. 9 showing the basic control unit 70Ba, the fuel injection volume computing unit 70*x*1 receives the signal of the target revolution speed command NR1 from the basic control unit 70Aa of the machine body controller and the signal of the actual revolution speed NE1 from the revolution speed sensor 72. Then, the unit 70*x*1 executes predetermined processing based on those input signals and produces the fuel injection volume command SE1. The processing in this step can be executed in a known manner. The fuel injection volume command SE1 is set, by way of example, as follows. If the revolution speed deviation ΔN resulted by subtracting the actual engine revolution speed NE1 from the target engine revolution speed NR1 is positive (ΔN>0), the target fuel injection volume is increased. If the revolution speed deviation ΔN is negative (ΔN<0), the target fuel injection volume is decreased. If the revolution speed deviation ΔN is 0 (ΔN=0), the current target fuel injection volume is maintained as it is. At this time, the produced command signal SE1 is modified depending on the environments by using the injection modification value ΔNFL which has been inputted together with the target revolution speed command NR1. The modified signal is outputted, as a final fuel injection volume command SE1, to the fuel injection device 14. When the environments are changed in a direction in which the engine output reduces, such as occurred upon lowering of the atmospheric pressure, and the modification control unit 70Bb computes the injection modification value ΔNFL as a larger value corresponding to the lowering of the atmospheric pressure (i.e., the reduction of the engine output), the fuel injection volume computing unit 70*x*1 modifies the fuel injection volume so as to increase depending on the injection modification value ΔNFL. As a result, the reduction of the engine output can be suppressed.

The fuel injection timing computing unit 70*x*2 receives the signal of the target revolution speed command NR1 from the basic control unit 70Aa of the machine body controller, executes predetermined processing based on the input signal, and produces the fuel injection timing command SE2. The processing in this step can be executed in a known manner. The target injection timing is computed, by way of example, such that when the target revolution speed is low, the injection timing is delayed relative to the engine revolution, and as the target revolution speed increases, the injection timing is advanced. The corresponding fuel injection timing command SE2 is then produced. At this time, the produced command signal SE2 is modified depending on the environments by using the injection modification value ΔNFL which has been inputted together with the target revolution speed command NR1. The modified signal is outputted, as a final fuel injection timing command SE2, to the fuel injection device 14. When the environments are changed in a direction in which the engine output reduces, such as occurred upon lowering of the atmospheric pressure, and the modification control unit 70Bb computes the injection modification value ΔNFL as a larger value corresponding to the lowering of the atmospheric pressure (i.e., the reduction of the engine output), the fuel injection timing computing unit 70*x*2 modifies the fuel injection timing so as to advance depending on the injection modification value ΔNFL. As a result, it is possible not only to suppress the reduction of the engine output, but also to realize improvements of fuel consumption and exhaust gas.

The fuel injection pressure computing unit 70*x*3 receives the signal of the target revolution speed command NR1 from the basic control unit 70Aa of the machine body controller, executes predetermined processing based on the input signal, and produces the fuel injection pressure command SE3. The processing in this step can be executed in a known manner. The target fuel injection pressure is computed, by way of example, such that when the target revolution speed is low, the fuel injection pressure is reduced, and as the engine target revolution speed increases, the fuel injection pressure becomes higher. The corresponding fuel injection pressure command SE3 is then produced. At this time, the produced command signal SE3 is modified depending on the environments by using the injection modification value ΔNFL which has been inputted together with the target revolution speed command NR1. The modified signal is outputted, as a final fuel injection pressure command SE3, to the fuel injection device 14. When the environments are changed in a direction in which the engine output reduces, such as occurred upon lowering of the atmospheric pressure, and the modification control unit 70Bb computes the injection modification value ΔNFL as a larger value corresponding to the lowering of the atmospheric pressure (i.e., the reduction of the engine output), the fuel injection pressure computing unit 70x3 modifies the fuel injection pressure so as to rise depending on the injection modification value ΔNFL. As a result, it is possible not only to suppress the reduction of the engine output, but also to realize improvements of fuel consumption and exhaust gas.

The fuel injection rate computing unit 70x4 receives the signal of the target revolution speed command NR1 from the basic control unit 70Aa of the machine body controller and the signal of the actual revolution speed NE1 from the revolution speed sensor 72. Then, the unit 70x4 executes predetermined processing based on those input signals and produces the fuel injection rate command SE4. The processing in this step can be executed in a known manner. The target fuel injection rate is computed, by way of example, such that when the target revolution speed is low, the fuel injection rate is reduced, and as the target engine revolution speed increases, the fuel injection rate is increased. The corresponding fuel injection rate command SE4 is then produced. Also, because the revolution speed deviation ΔN resulted by subtracting the actual engine revolution speed NE1 from the target revolution speed NR1 is a value depending on change of the engine load, the fuel injection rate is controlled such that it is reduced as the revolution speed deviation ΔN (engine load) increases. The concept of such fuel injection rate control is described in detail in JP,A 10-339189. At this time, the produced command signal SE4 is modified depending on the environments by using the injection modification value ΔNFL which has been inputted together with the target revolution speed command NR1. The modified signal is outputted, as a final fuel injection rate command SE4, to the fuel injection device 14. When the environments are changed in a direction in which the engine output reduces, such as occurred upon lowering of the atmospheric pressure, and the modification control unit 70Bb computes the injection modification value ΔNFL as a larger value corresponding to the lowering of the atmospheric pressure (i.e., the reduction of the engine output), the fuel injection rate computing unit 70x4 modifies the fuel injection ate so as to increase depending on the injection modification value ΔNFL. As a result, it is possible not only to suppress the reduction of the engine output, but also to realize improvements of fuel consumption and exhaust gas.

In FIG. 10 showing the modification control unit 70Bb, as in the modification gain computing units 70m1, 70n1, 70q1, 70r1, 70s1, 70t1, 70u1 and 70v1 described above in connection with FIG. 7, the modification gain computing units 70m2, 70n2, 70q2, 70r2, 70s2, 70t2, 70u2 and 70v2 of the modification control unit 70Bb receive the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH. Then, the modification control unit 70Bb computes the corresponding second modification gains K2TA, K2TF, K2TW, K2TI, K2PI, K2TO, K2PO, K2TL and K2TH by referring to the respective tables stored in the memories.

The injection modification value computing unit 70w2 computes the injection modification value ΔNFL by applying respective weights to the second modification gains computed in the modification gain computing units 70m2 to 70v2. A computing process is as follows. As in the torque modification value computing unit 70w1, for the specific performance of the engine, the amounts by which the engine output reduces with the respective modification gains are determined in advance, and a reference injection modification value ΔNB for the injection modification value ΔNFL to be computed is stored as a constant in the modification control unit 70Bb. Further, the respective weights to be applied to the modification gains are determined in advance, and modification amounts based on the respective weights are stored, as a matrix of A, B, C, D, E, F, C, H and I in the modification control unit 70Bb. By using those values, the injection modification value ΔNFL is computed based on a calculation formula shown in the injection modification value computing block shown in FIG. 10. Note that a similar effect is obtained by using a quadratic equation, for example, instead of the calculation formula shown in FIG. 10.

The thus-computed injection modification value ΔNFL is inputted to each of the fuel injection volume computing unit 70x1, the fuel injection timing computing unit 70x2, the fuel injection pressure computing unit 70x3, and the fuel injection rate computing unit 70x4 of the basic control unit 70Ba. Then, the computing units 70x1, 70x2, 70x3 and 70x4 modify and output the command signals SE1 to SE4 depending on the environments as described above. Upon receiving the command signals SE1, SE2, SE3 and SE4, the fuel injection device 14 controls the fuel injection volume, the fuel injection timing, the fuel injection pressure, and the fuel injection rate for the prime mover 10 in the above-described manner.

Returning to FIG. 8, the computation element altering unit 181 receives a computation element (alteration data) for the injection modification from the outside of the machine body through the communication controller 70C, and alters (e.g., updates, modifies, or rewrites) the tables themselves, shown in FIG. 10, used in the modification gain computing units 70m2 to v2 of the modification control unit 70Bb, the computation matrix used in the injection modification value computing unit 70w2, other arithmetic operators (such as the constant ΔNB), etc.

The information collecting unit 182 collects various items of information including the above-described various detected environment signals (environment information) from the environment sensors 75 to 83 to the engine control unit 180, i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH; a detected operation signal (operation information), i.e., the actual engine revolution speed NE1, which is inputted to the engine control unit 180 from the sensor 72; a computed value (internal computation information) of the target engine revolution speed NR1 inputted from the machine body controller 70A; and command values (command information) such as the fuel injection volume command SE1, the fuel injection timing command SE2, the fuel injection pressure command SE3, and the fuel injection rate command SE4 which are outputted to the fuel injection device 14. Those items of information are collected, for example, by storing the information in a memory at the proper timing. The collected information is outputted to the outside of the machine body through the communication controller 70C.

(3) Communication Controller 70C

Returning to FIG. 4, the communication controller 70C is connectable to an external terminal 150 via, e.g., a cable. The external terminal 150 is, for example, a portable terminal (such as a notebook personal computer). Therefore, the tables themselves used in the modification gain computing units 70*m*1 to v1 and 70*m*2 to v2, the computation matrices used in the torque modification value computing unit w1 and the injection modification value computing unit w2, etc. can be altered (e.g., updated, modified, or rewritten) through the steps of carrying the portable terminal 150 to the hydraulic excavator working in the site at the time of, e.g., mechanical check, connecting the portable terminal 150 to the communication controller 70C via the cable, and performing a predetermined input operation on the side of the portable terminal 150 (or any of the controllers 70A to 70C) so that a computation element for the torque modification and/or a computation element for the injection modification, which has been installed in the portable terminal 150 beforehand, is downloaded into the computation element altering unit 171 of the machine body controller 70A or the computation element altering unit 181 of the engine controller 70B through the communication controller 70C.

Also, by performing a predetermined input operation on the side of the portable terminal 150 connected to the communication controller 70C via the cable (or the side of any of the controllers 70A to 70C), the various items of information collected by the information collecting unit 172 of the machine body controller 70A or the various items of information collected by the information collecting unit 182 of the engine controller 70B can be uploaded to the side of the portable terminal 150.

The operation and advantages of this embodiment having the above-described construction will be described below.

In the case of carrying out excavation work in highland, for example, when the output of the prime mover 10 reduces with changes of the environments (such as lowering of the atmospheric pressure), the sensors 75 to 83 detect those changes of the environments.

Then, the modification gain computing units 70*m*1 to 70*v*1 and the torque modification value computing unit 70*w*1 of the machine body controller 70A receive the respective sensor signals and execute the processing to determine the absorption torque TR1 (target maximum absorption torque) through the steps of estimating, as the torque modification value ΔTFL, the lowering of the engine output based on the respective tables, which have been set and stored beforehand as shown in FIG. 7, and adding the torque deviation ΔTNL, which is obtained by subtracting the torque modification value ΔTFL from the speed-sensing torque deviation ΔT1, to the pump base torque TR0 in the speed-sensing torque deviation modifying unit 70*i* and the base torque computing unit 70*j*. Stated another way, in this processing, the lowering of the engine output attributable to the changes of the environments is computed as the torque modification value ΔTFL, and the target maximum absorption torque TR1 is reduced in advance by reducing the pump base torque TR0 by an amount corresponding to the lowering of the engine output.

Also, the modification gain computing units 70*m*2 to 70*v*2 and the injection modification value computing unit 70*w*2 of the engine controller 70B receive the respective sensor signals and estimate, as the injection modification value ΔNFL, the lowering of the engine output based on the respective tables, which have been set and stored beforehand as shown in FIG. 10. In consideration of the injection modification value ΔNFL thus estimated, the fuel injection volume computing unit 70*x*1, the fuel injection timing computing unit 70*x*2, the fuel injection pressure computing unit 70*x*3, and the fuel injection rate computing unit 70*x*4 modify the fuel injection volume command SE1, the fuel injection timing command SE2, the fuel injection pressure command SE3, and the fuel injection rate command SE4, respectively, followed by outputting the modified final command signals SE1, SE2, SE3 and SE4 to the fuel injection device 14. Stated another way, in this processing, the lowering of the engine output attributable to the changes of the environments is computed as the injection modification value ΔNFL, and the fuel injection volume, the fuel injection timing, the fuel injection pressure and the fuel injection rate are optimized so as to compensate for the lowering of the engine output. As a result, it is possible not only to minimize the reduction of the engine output, but also to realize improvements of fuel consumption and exhaust gas.

With the above-described functions of the controllers 70A, 70B, even when the engine output reduces with changes of the environment, the engine can be prevented from stalling, the reduction of the engine revolution speed can be suppressed, and satisfactory work efficiency can be ensured. Further, improvements of fuel consumption and exhaust gas can be realized.

Construction machines such as hydraulic excavators may be possibly operated in any places all over the world. Therefore, when construction machines are operated in areas including land at very high altitudes, desert, marshland, extremely cold land, and extremely hot land, or when they are operated in countries and seasons where fuel situations (such as fuel composition and legal restrictions on the kind of fuel) are much different (namely, in the case of special use), changes of the conditions cannot be sufficiently adapted sometimes with only the modification using the computation elements used for the torque modification in the modification control unit 70Ab of the machine body controller (=the tables themselves used in the modification gain computing units 70*m*1 to 70*v*1, the computation matrix used in the torque modification value computing unit 70*w*1, etc.), or the computation elements used for the injection modification in the modification control unit 70Bb of the engine controller (=the tables themselves used in the modification gain computing units 70*m*2 to 70*v*2, the computation matrix used in the injection modification value computing unit 70*w*2, etc.). For example, construction machines may be operated under conditions outside the varying ranges of the environment factors which have been assumed at the time of preparing the tables (specifically, construction machines may be operated at an altitude of 3000 m in practice in spite of the design assuming the altitude up to 2000 m). In such a practical case, there may occur a phenomenon, by way of example, that although the target engine revolution speed input unit 71 instructs the target engine revolution speed of about 2000 rpm, the actual revolution speed detected by the revolution speed sensor 72 is much lower than 2000 rpm.

In such a case, according to this embodiment, a serviceman, for example, carries the portable terminal 150 to the hydraulic excavator working in the site, connects the portable terminal 150 to the communication controller 70C via the cable, and performs the predetermined input operation on the side of the portable terminal 150 (or the side of any of the controllers 70A to 70C). Thereby, a new different computation element (e.g., correlation) for the torque modification and/or that for the injection modification, which has been installed in the portable terminal 150 beforehand, is downloaded, as alteration data to be substituted for the computation element already set and held in the machine body controller 70A or the engine controller 70B, into the machine body controller 70A or the engine controller 70B through the communication controller 70C. As a result, the tables themselves used in the modification gain computing units 70*m*1 to v1 and 70*m*2 to v2, the computation matrices used in the torque modification value computing unit w1 and the injection modification value computing unit w2, etc. can be altered (e.g., updated, modified, or rewritten). As a matter of course, if it is known beforehand that the construction machine is going to be operated in the special work site, the above-mentioned alteration of the computation element may also be performed before the construction machine is dispatched to the work site instead of after having arrived at the work site. When altering the computation element as described above, it is also possible to prepare a plurality of computation elements (alteration data) on the side of the portable terminal 150, to select one of the plurality of computation elements with an appropriate input operation made on the side of the portable terminal 150, and to download the selected computation element to the side of the machine body controller 70A or the engine controller 70B. Alternatively, the computation element already set and held in the machine body controller 70A or the engine controller 70B may be freely corrected or modified with an appropriate input operation made on the side of the portable terminal 150.

Thus, by enabling the computation element (e.g., correlation) for the modification, which has been set and held on the hydraulic excavator side, to be altered at a later time with an external input, even in the working environments, for example, where changes of the conditions have not been fully estimated in the stage of design and cannot be sufficiently adapted with the computation element for the modification, which has been set and held in the hydraulic excavator, it is possible to appropriately modify the maximum absorption torque of the hydraulic pumps 1, 2 or modify the fuel injection state of the fuel injection device 14, and to sufficiently develop the performance of the hydraulic excavator.

Also, changes of the conditions are not limited to changes of the environments mentioned above. In some cases, in spite of the environments being not changed, the modification cannot be satisfactorily performed only with the computation element for the modification (i.e., the computation element for the torque modification or the computation element for the injection modification), which has been set and held on the construction machine side, because of deterioration of the construction machine itself with time. Even in such a case, by appropriately altering the computation element for the modification with an external input from the portable terminal 150 as mentioned above, the computation element can be modified to be sufficiently adapted for new conditions. Further, this embodiment is also effective for the case (so-called upgrade) in which control of higher performance than that at the time of manufacturing will be enabled in practice with subsequent progress of the technology. Thus, by altering the computation element for the modification to the latest one with an external input from the portable terminal 150 as mentioned above, the accuracy of the modification can be improved and the modification can be performed in a more satisfactory and finer manner.

Moreover, during the operation of the construction machine after modifying, as described above, the fuel injection state or the pump maximum absorption torque with a new computation element for the torque modification or a new computation element for the injection modification which has been inputted from the outside through the portable terminal 150, the information collecting units 172, 182 of the machine body controller 70A and the engine controller 70B collect various items of information including the various detected environment signals (environment information), i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH; the various detected operation signals (operation information), i.e., the actual engine revolution speed NE1, the hydraulic pump control pilot pressures PL1, PL2, and the hydraulic pump delivery pressures P1, P2; the manipulation signal (manipulation information), i.e., the target engine revolution speed NR0; the computed values (internal computation information) such as the target engine revolution speed NR1, and the absorption torque TR1 and the target tilting θR1, θR2 of the hydraulic pumps 1, 2; and the command values (command information), i.e., the fuel injection volume command SE1, the fuel injection timing command SE2, the fuel injection pressure command SE3, and the fuel injection rate command SE4. Accordingly, by performing the predetermined input operation on the side of the portable terminal 150 (or any of the controllers 70A to 70C) at an appropriate time in the state where the portable terminal 150 is connected to the communication controller 70C via the cable, the various collected information can be uploaded to the side of the portable terminal 150.

As a result, it is possible to surely monitor whether the above-mentioned modification of the fuel injection state or the pump maximum absorption torque, which has been performed with a new computation element for the torque modification or a new computation element for the injection modification inputted from the outside through the portable terminal 150, is satisfactorily successful or not. Further, by reflecting the monitored result on other construction machines which will be operated under similar working environments to those of the relevant construction machine after that, the modification can be satisfactorily performed in a quick and reliable manner. Moreover, by repeating such monitoring and collecting the monitored data in the form of, e.g., a database, suitability of the modification can be judged with learning. The modification can be therefore performed in a more satisfactory and finer manner.

In addition, by using the environment information obtained from the various detected environment signals, an appropriate computation element (alteration data) for the torque modification or an appropriate computation element (alteration data) for the injection modification can be selected or prepared on the side of the external terminal 150.

Figure 11:
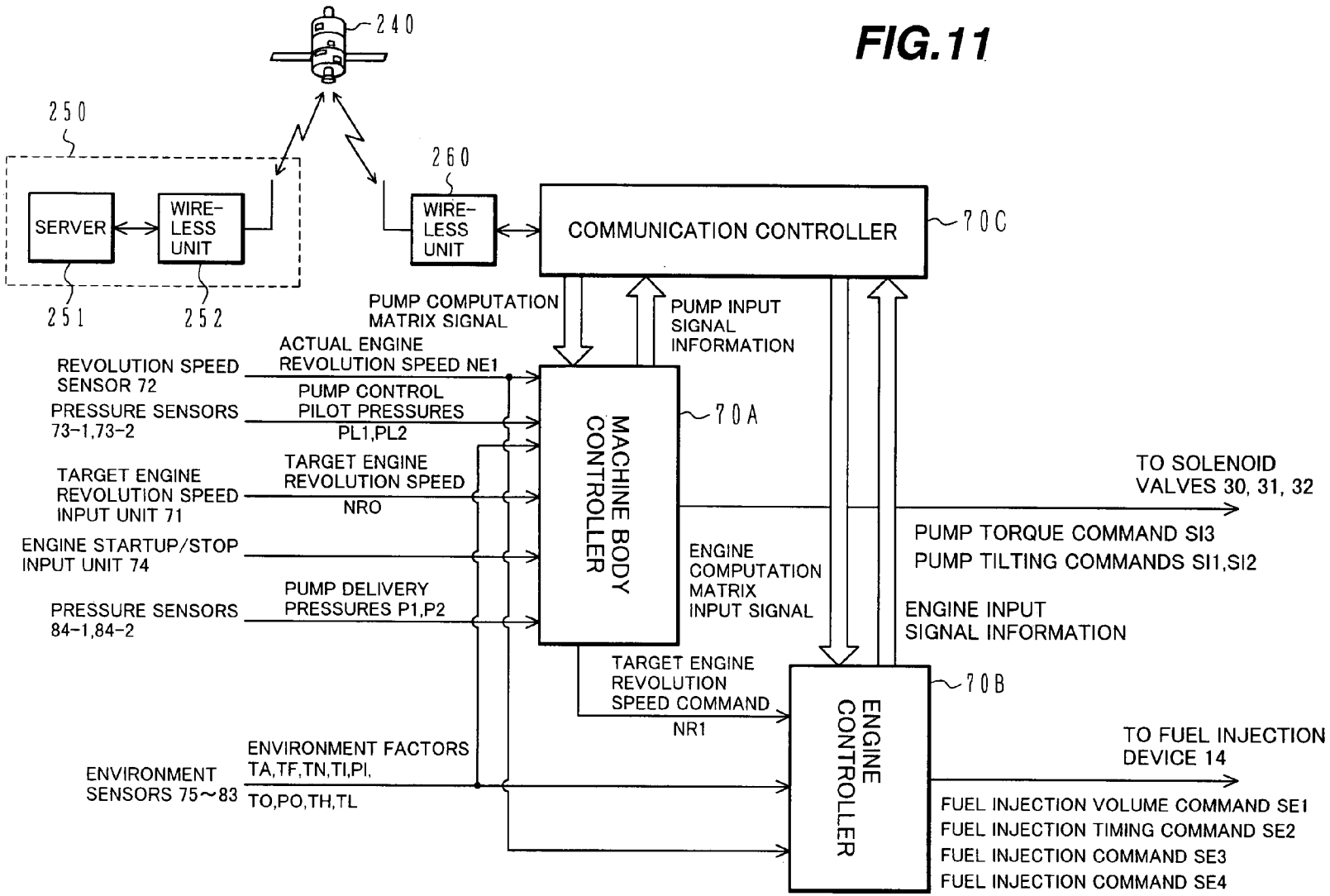
FIG. 11 is a conceptual diagram showing a flow of signal processing as a principal part of another embodiment of the signal processing system for the construction machine according to the present invention.

Another embodiment of the present invention will be described below with reference with FIG. 11. In FIG. 11, identical components to those shown in FIG. 4 are denoted by the same symbols. This embodiment is intended to alter the computation element for the modification via satellite communication.

As shown in FIG. 11, in this embodiment, information is communicated with wireless communication via a communication satellite 240 instead of communicating information via the connecting cable with respect to the external terminal. In this case, a server 251 is installed, as the external terminal, in an office 250, e.g., a main office, a branch office, or a factory of a construction machine manufacturing maker (or a dealer, a service firm, etc.), and the server 251 is connected to a wireless unit 252. The communication controller 70C on the hydraulic excavator is connected to a wireless unit 260.

The communication controller 70C transmits the various items of information, which have been collected by the information collecting units 172, 182 of the machine body controller 70A and the engine controller 70B during the operation of the hydraulic excavator (during the operation based on the computation elements for the torque modification and the injection modification which have been originally set and held, i.e., before alteration of the computation elements), to the server 251 (external terminal) with wireless communication via the wireless units 260, 252 and the communication satellite 240, the various items of information including the various detected environment signals (environment information), i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, the engine oil temperature sensor signal TL, and the hydraulic fluid temperature sensor signal TH; the various detected operation signals (operation information), i.e., the actual engine revolution speed NE1, the hydraulic pump control pilot pressures PL1, PL2, and the hydraulic pump delivery pressures P1, P2; the manipulation signal (manipulation information), i.e., the target engine revolution speed NR0; the computed values (internal computation information) such as the target revolution speed NR1, and the absorption torque TR1 and the target tilting θR1, θR2 of the hydraulic pumps 1, 2; and the command values (command information) such as the fuel injection volume command SE1, the fuel injection timing command SE2, the fuel injection pressure command SE3, and the fuel injection rate command SE4.

At the server 251, a person in charge of information processing, for example, monitors the transmitted various items of information. When the person judges from, e.g., the operation information that the computation elements for the torque modification and the injection modification, which have been so far set and held, do not satisfactorily function under the environments at the relevant work site and the modification is not sufficiently successful, or when the operator of the relevant hydraulic excavator informs the person in charge of information processing of such a judgment with, e.g., a cell phone, or when it is determined from positional information issued based on the so-called GPS function equipped in the hydraulic excavator that sufficient modification is difficult to realize under the environments at the work site, one or more among a plurality of various computation elements (alteration data) prepared on the side of the server 251 are selected and transmitted from the server 251 to the communication controller 70C via wireless communication. On that occasion, appropriate alteration data can be selected based on the environment information obtained from the various detected environment signals. If there is no appropriate one among the altered date prepared in advance, appropriate alteration data can be created based on the environment information.

Upon receiving the alteration data, the communication controller 70C downloads the received data into the computation element altering unit 171 of the machine body controller 70A and/or the computation element altering unit 181 of the engine controller 70B, thereby altering the relevant one(s) among the computation elements which have been so far set and held in the modification control units 70Ab, 70Bb of the machine body controller 70A and/or the engine controller 70B.

Instead of the person, who is in charge of information processing, performing the operation for transmitting the information and altering the computation elements as described above, when the operator of the hydraulic excavator, for example, judges from the operating state of the relevant hydraulic excavator that the computation elements for the torque modification and the injection modification, which have been so far set and held, do not satisfactorily function under the environments at the relevant work site and the modification is not sufficiently successful (e.g., when, as mentioned above, the target engine revolution speed input unit 71 instructs the target engine revolution speed of about 2000 rpm, but the actual revolution speed detected by the revolution speed sensor 72 is much lower than 2000 rpm), new computation elements may be automatically downloaded from the server 251 via the satellite communication 240 upon manipulation of an appropriate operating means on the hydraulic excavator side (for example, upon depression of a button disposed on an operating panel). Further, the present invention is not limited to the case where the operator makes such a judgment. The judging function may be prepared in any of the communication controller 70C, the machine body controller 70A and the engine controller 70B such that, for example, when any of the detected signals NE1, PL1, PL2, P1 and P2 (i.e., the detected operation signals) from the sensors 72, 73-1, 73-2, 84-1 and 84-2 departs from a preset certain range (appropriate operating range), new correlations are automatically downloaded from the server 251 via the satellite communication 240. As an alternative, it is also possible to prompt the person in charge of information processing on the side of the server 251 or the operator of the hydraulic excavator to make only final confirmation as to whether the downloading is to be started or not.

Wireless communication with a cell phone may also be utilized instead of wireless communication via the communication satellite 240.

This embodiment can also provide similar advantages to those obtainable with the above-described embodiment.

Still another embodiment of the present invention will be described below with reference to FIGS. 5, 6, 8 and 9 although these drawings are concerned with the first embodiment.

While the above embodiments have been described as altering the computation elements for the modification prepared in the modification control unit 70Ab of the machine body controller 70A and the modification control unit 70Bb of the engine controller 70B, this embodiment is intended to achieve the equivalent purpose by altering other computation elements.

More specifically, in this embodiment, the computation element altering unit 171 shown in FIG. 5 and the computation element altering unit 181 shown in FIG. 8 modify, update or replace at least a part of basic computing functions in the basic control unit 70Aa of the machine body controller 70A and the basic control unit 70Ba of the engine controller 70B, i.e., computation elements for the torque control (such as correlations, gains, and other various arithmetic operators used in the base torque computing unit 70*e*, the torque converting unit 70*g*, the limiter computing unit 70*h*, and the solenoid output current computing unit 70*k* shown in FIG. 6) and computation elements for the injection control (such as correlations, gains, and other various arithmetic operators used in the fuel injection volume computing unit 70*x*1, the fuel injection timing computing unit 70*x*2, the fuel injection pressure computing unit 70*x*3, and the fuel injection rate computing unit 70*x*4 shown in FIG. 9). As a result, the maximum absorption torque of the hydraulic pumps 1, 2 and the fuel injection state of the prime mover 10 are modified. Additionally, the computation element altering units 171, 181 obtain alteration data for the modification from the outside of the machine body via the communication controller 70C.

This embodiment can also provide similar advantages to those obtainable with the above-described embodiments.

It is to be noted that the present invention is not limited to the embodiments described above and can be modified in various ways without departing from the purport and the scope of technical concept of the invention.

For example, in the above embodiments, there are three controllers, i.e., the communication controller 70C, the machine body controller 70A, and the engine controller 70B. However, the number of controllers is not limited to three, and any two of the three functions may be integrated into one controller so that two controllers are provide in total. Alternatively, all the three functions may be integrated into one controller.

Also, the above embodiments have been described as employing, as the environment factors detected by the environment sensors 75 to 83 described above, i.e., the atmospheric pressure TA, the fuel temperature TF, the cooling water temperature TW, the intake temperature TI, the intake pressure PI, the exhaust temperature TO, the exhaust pressure PO, the engine oil temperature TL, and the hydraulic fluid temperature TH. However, the environment factors are not limited to those ones, and any other suitable environment factor, e.g., an engine oil pressure, may also be detected.

Further, the above embodiments have been described in connection with, as examples of the detected operation signals, the actual engine revolution speed NE1, the hydraulic pump control pilot pressures PL1, PL2, and the hydraulic pump delivery pressures P1, P2. However, the detected operation signals are not limited to those examples, and any of the tilting angles of respective swash plates of the hydraulic pumps 1, 2, the revolution speeds of the hydraulic pumps 1, 2 themselves (e.g., in the case where the pump revolution speeds differ from the engine revolution speed), the engine fuel injection pressure, and the engine injection timing may also be detected.

Moreover, the above embodiments have been described in connection with a hydraulic excavator as one example of construction machines. However, the present invention is also applicable to a crawler crane, a wheel loader, or the like. Any of these applications can also provide similar advantages to those described above.

INDUSTRIAL APPLICABILITY

According to the present invention, the computation elements, which have been once set and held on the construction machine side, can be altered with a subsequent external input. Therefore, even when the construction machine is operated under the working environments that cannot be sufficiently adapted with the setting made at the time of designing environment modifying means, it is possible to appropriately modify the fuel injection state of the fuel injection device and the maximum absorption torque of the hydraulic pump, and to sufficiently develop the performance of the construction machine.

Since various items of information including the detected environment signals from environment detecting means are collected and transmitted to the external terminal, appropriate alteration data for the computation elements can be selected or created on the external terminal side by using the environment information obtained from the detected environment signals.

Further, since various items of information including the detected operation signals from operation detecting means are collected and transmitted to the external terminal, whether the computation elements have been appropriately altered or not can be monitored by using the operation information obtained from the detected operation signals.

What is claimed is:

1. A signal processing system for a construction machine comprising a prime mover, a variable displacement hydraulic pump driven by said prime mover, a fuel injection device for controlling fuel injection in said prime mover, input means for commanding a target revolution speed of said prime mover, revolution speed detecting means for detecting an actual revolution speed of said prime mover, fuel injection control means for controlling a fuel injection state of said fuel injection device in accordance with the target revolution speed commanded from said input means and the actual revolution speed detected by said revolution speed detecting means, and pump torque control means for controlling a maximum absorption torque of said hydraulic pump in accordance with the target revolution speed commanded from said input means and the actual revolution speed detected by said revolution speed detecting means, wherein said signal processing system further comprises:

a plurality of environment detecting means for detecting status variables related to environments of said prime mover or said hydraulic pump and outputting respective corresponding detected environment signals;

environment modifying means for receiving the detected environment signals and modifying, in accordance with the detected environment signals, at least one of the fuel injection state of said fuel injection device controlled by said fuel injection control means and the maximum absorption torque of said hydraulic pump controlled by said pump torque control means;

communication control means for obtaining, from an external terminal via communication, alteration data for altering one or more computation elements contained in at least one of said fuel injection control means, said pump torque control means and said environment modifying means;

computation element altering means for altering the computation elements based on the alteration data obtained by said communication control; and information collecting means for collecting various items of information including the detected environment signals from said environment detecting means, wherein said communication control means outputs the various items of information obtained by said information collecting means to said external terminal via communication, and said communication control means performs communication with respect to said external terminal in a wireless manner.

2. A signal processing system for a construction machine according to claim 1, wherein:

said environment modifying means is pump torque modifying means for modifying the maximum absorption torque of said hydraulic pump, which is controlled by said pump torque control means, in accordance with the detected environment signals by using a predetermined computation element for torque modification; and said communication control means is means for obtaining, from said external terminal, alteration data for altering the computation element for torque modification, and said computation element altering means is means for altering the computation element for torque modification based on the obtained alteration data.

3. A signal processing system for a construction machine according to claim 1, wherein:

said environment modifying means is fuel injection modifying means for modifying the fuel injection state of said fuel injection device, which is controlled by said fuel injection control means, in accordance with the detected environment signals by using a predetermined computation element for injection modification; and said communication control means is means for obtaining, from said external terminal, alteration data for altering the computation element for injection modification, and said computation element altering means is means for altering the computation element for injection modification based on the obtained alteration data.

4. A signal processing system for a construction machine according to claim 1, wherein:

said environment modifying means includes pump torque modifying means for modifying the maximum absorption torque of said hydraulic pump, which is controlled by said pump torque control means, in accordance with the detected environment signals by using a predetermined computation element for torque modification, and fuel injection modifying means for modifying the fuel injection state of said fuel injection device, which is controlled by said fuel injection control means, in accordance with the detected environment signals by using a predetermined computation element for injection modification; and said communication control means is means for obtaining, from said external terminal, alteration data for altering the computation element for torque modification and the computation element for injection modification, and said computation element altering means are means for altering the computation element for torque modification and the computation element for injection modification based on the obtained alteration data.

5. A signal processing system for a construction machine according to claim 1, wherein:

said pump torque control means is means for controlling the maximum absorption torque of said hydraulic pump based on the target revolution speed and the actual revolution speed by using a predetermined computation element for torque control; and said communication control means is means for obtaining, from said external terminal, alteration data for altering the computation element for torque control, and said computation element altering means is means for altering the computation element for torque control based on the obtained alteration data.

6. A signal processing system for a construction machine according to claim 1, wherein:

said fuel injection control means is means for controlling the fuel injection state of said fuel injection device based on the target revolution speed and the actual revolution speed by using a predetermined computation element for injection control; and said communication control means is means for obtaining, from said external terminal, alteration data for altering the computation element for injection control, and said computation element altering means is means for altering the computation element for injection control based on the obtained alteration data.

7. A signal processing system for a construction machine according to claim 1, wherein:

said pump torque control means is means for controlling the maximum absorption torque of said hydraulic pump based on the target revolution speed and the actual revolution speed by using a predetermined computation element for torque control;

said fuel injection control means is means for controlling the fuel injection state of said fuel injection device based on the target revolution speed and the actual revolution speed by using a predetermined computation element for injection control; and said communication control means is means for obtaining, from said external terminal, alteration data for altering the computation element for torque control and the computation element for injection control, and said computation element altering means are means for altering the computation element for torque control and the computation element for injection control based on the obtained alteration data.

8. A signal processing system for a construction machine according to claim 1, wherein:

said signal processing system further comprises operation detecting means for detecting status variables related to the operating state of said prime mover or said hydraulic pump and outputting corresponding detected signals; and said information collecting means is means for collecting various items of information including the detected environment signals from said environment detecting means and detected operation signals from said operation detecting means.

9. A signal processing system for a construction machine according to claim 1, wherein said environment detecting means are means for detecting at least one of environment factors including an intake pressure, an intake temperature, an exhaust temperature, an exhaust pressure, a cooling water temperature, a lubricant pressure and a lubricant temperature of said prime mover, an atmospheric pressure, a fuel temperature, and a hydraulic fluid temperature.

* * * * *

UNITED STATES PATENT AND TRADEMARK OFFICE

CERTIFICATE OF CORRECTION

PATENT NO. : 7,020,553 B2
APPLICATION NO. : 10/500032
DATED : March 28, 2006
INVENTOR(S) : K. Nakamura et al.

It is certified that error appears in the above-identified patent and that said Letters Patent is hereby corrected as shown below:

Title page item (75) should read -- Inventors: Kazunori Nakamura, Tsuchiura (JP); Toichi HIRATA, Ushiku (JP); Yasushi ARAI, Tsuchiura (JP); Yoichi KOWATARI, Ibaraki-ken (JP); -- Yoshinori FURUNO, Tsuchiura (JP) --; Gen Yasuda, Ibaraski-ken (JP); and Hiroshi WATANABE, Ushiku (JP).

Signed and Sealed this

Fifteenth Day of August, 2006

JON W. DUDAS
*Director of the United States Patent and Trademark Office*